US010741192B2

(12) United States Patent
Rajendran et al.

(10) Patent No.: US 10,741,192 B2
(45) Date of Patent: Aug. 11, 2020

(54) SPLIT-DOMAIN SPEECH SIGNAL ENHANCEMENT

(71) Applicant: QUALCOMM Incorporated, San Diego, CA (US)

(72) Inventors: Vivek Rajendran, San Diego, CA (US); Duminda Dewasurendra, San Diego, CA (US); Daniel Jared Sinder, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 187 days.

(21) Appl. No.: 15/973,214

(22) Filed: May 7, 2018

(65) Prior Publication Data

US 2019/0341067 A1 Nov. 7, 2019

(51) Int. Cl.

| | |
|---|---|
| ***G10L 21/0208*** | (2013.01) |
| ***G10L 25/30*** | (2013.01) |
| ***G10L 25/12*** | (2013.01) |
| ***G10L 25/90*** | (2013.01) |

(52) U.S. Cl.

CPC ..... *G10L 21/0208* (2013.01); *G10L 25/12* (2013.01); *G10L 25/30* (2013.01); *G10L 25/90* (2013.01)

(58) Field of Classification Search

CPC ..... G10L 21/0208; G10L 19/02; G10L 19/04; G10L 21/0232; G10L 19/06; G10L 25/12

See application file for complete search history.

(56) References Cited

U.S. PATENT DOCUMENTS

| | | | | |
|---|---|---|---|---|
| 7,065,486 | B1 * | 6/2006 | Thyssen | G10L 21/0208 704/215 |
| 7,454,330 | B1 * | 11/2008 | Nishiguchi | G10L 19/02 704/224 |
| 2018/0204580 | A1 * | 7/2018 | Fischer | G10L 21/0232 |

OTHER PUBLICATIONS

M. Honda, "Speech coding using waveform matching based on LPC residual phase equalization," International Conference on Acoustics, Speech, and Signal Processing, Albuquerque, NM, USA, 1990, pp. 213-216 vol. 1.*

S. Ahmadi and A. S. Spanias, "A new phase model for sinusoidal transform coding of speech," in IEEE Transactions on Speech and Audio Processing, vol. 6, No. 5, pp. 495-501, Sep. 1998.*

* cited by examiner

*Primary Examiner* — Matthew H Baker
(74) *Attorney, Agent, or Firm* — Moore IP

(57) ABSTRACT

A method and an apparatus for estimating speech signal in split-domain is disclosed. The method includes performing LP analysis on a noisy speech signal to generate a first plurality of LPC and a first residual signal. The method also includes estimating speech LPC spectrum to generate cleaned LPC. The method further includes estimating speech residual spectrum to generate cleaned residual signal. The method also includes synthesizing output signals based on the cleaned LPC and the cleaned residual signal.

30 Claims, 10 Drawing Sheets

700

SPLIT-DOMAIN SPEECH SIGNAL ENHANCEMENT

I. FIELD

The present disclosure is generally related to signal process and, more particularly, is related with improving speech signals from noisy speech signals.

II. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These mobile devices can communicate voice and data packets over wireless networks. Further, many such devices incorporate additional functionality such as a digital still camera, a digital video camera, a digital recorder, and an audio file player. Also, such mobile devices can process executable instructions, including software applications, such as a web browser application, that can be used to access the Internet. As such, these mobile devices can include significant computing capabilities.

A mobile device may include a microphone that is operable to capture audio (e.g., any audible sound including speech, noise, and music) based on the effects of surface vibrations on a light beam emitted by the microphone. To illustrate, the microphone may direct the light beam to a surface that is proximate to a sound source, and vibrations of the surface, caused by sound waves from the sound source, may change properties of the reflected light beam. For example, the vibrations of the surface may change a frequency of the light beam and a phase of the light beam. The change in properties may be used at the microphone to capture sound at the surface. For example, a reflected light beam (having the changed properties) from the surface may be received by the microphone, and the microphone may generate audio representative of the sound based on the reflected light beam. However, the audio generated based on the reflected light beam may have low quality due to the various noises. For example, these noises may include background noise, or any other noise introduced due to a location of the surface, a material of the surface, or the vibration of the surface.

A common model for a noisy signal, $v(t)$, is a signal, $s(t)$, plus additive noise, $n(t)$, that $v(t)=s(t)+n(t)$. Examples of some of traditional methods of noise suppression include spectral subtraction, Wiener filtering, and variations of these methods modified to increase the intelligibility of audio signal and/or reduce adverse artifacts. Due to the increased computation complexity of mobile devices, many of rather complex algorithms have been recently gaining more popularity. To illustrate, some of these complex algorithms may be based on deep neural network (DNN), or non-negative matrix factorization (NMF).

III. SUMMARY

According to one implementation of the techniques disclosed herein, a method of estimating speech signal includes receiving, at a microphone, input signals that include at least a noise signal component and a speech signal component. The method also includes performing a first filtering operation on a first portion of the input signals to generate a plurality of first linear predictive filter coefficients (LPC) and a first residual signal. The method also includes calculating frequency response of the plurality of the first LPC to generate a first magnitude spectrum and a first phase spectrum. The method further includes converting the first residual signal into frequency-domain signal to generate a second magnitude spectrum and a second phase spectrum. The second magnitude spectrum corresponds to magnitude component of the first residual signal in frequency domain and the second phase spectrum corresponds to phase component of the first residual signal in frequency domain. The method also includes estimating a third magnitude spectrum based on the first magnitude spectrum and estimating a fourth magnitude spectrum component based on the second magnitude spectrum. The third magnitude spectrum may correspond to the speech signal component, and the fourth magnitude spectrum may also correspond to the speech signal component. The method also includes synthesizing output signals based on the third magnitude spectrum and the fourth magnitude spectrum.

According to another implementation of the techniques disclosed herein, an apparatus for estimating speech signal includes a microphone, a memory coupled to the microphone, and a processor coupled to the memory. The microphone is configured to receive input signals that include at least a noise signal component and a speech signal component. The memory is configured to store the input signals. The processor is configured to perform a first filtering operation on a first portion of the input signals to generate a plurality of first linear predictive filter coefficients (LPC) and a first residual signal. The processor is also configured to calculate frequency response of the plurality of the first LPC to generate a first magnitude spectrum and a first phase spectrum. The processor is also configured to convert the first residual signal into frequency-domain signal to generate a second magnitude spectrum and a second phase spectrum. The processor is further configured to estimate a third magnitude spectrum based on the first magnitude spectrum and estimate a fourth magnitude spectrum based on the second magnitude spectrum. The third magnitude spectrum may correspond to the speech signal component, and the fourth magnitude spectrum may also correspond to the speech signal component. The processor is also configured to synthesize output signals based on the third magnitude spectrum and the fourth magnitude spectrum.

According to another implementation of the techniques disclosed herein, a non-transitory computer-readable medium includes instructions that, when executed by a processor, cause the processor to perform operations including estimating speech signal includes receiving, at a microphone, input signals that include at least a noise signal component and a speech signal component. The operations also include performing a first filtering operation on a first portion of the input signals to generate a plurality of first linear predictive filter coefficients (LPC) and a first residual signal. The operations also include calculating frequency response of the plurality of the first LPC to generate a first magnitude spectrum and a first phase spectrum. The operations further include converting the first residual signal into frequency-domain signal to generate a second magnitude spectrum and a second phase spectrum. The second magnitude spectrum corresponds to magnitude component of the first residual signal in frequency domain and the second phase spectrum corresponds to phase component of the first residual signal in frequency domain. The operations also include estimating a third magnitude spectrum based on the first magnitude spectrum and estimating a fourth magnitude spectrum component based on the second magnitude spectrum. The third magnitude spectrum may correspond to the speech signal component, and the fourth magnitude spectrum may also correspond to the speech signal component. The operations also include synthesizing output signals based on the third magnitude spectrum and the fourth magnitude spectrum.

According to another implementation of the techniques disclosed herein, an apparatus for estimating speech signal includes means for receiving input signals that include at least a noise signal component and a speech signal component. The apparatus also includes means for performing a first filtering operation on a first portion of the input signals to generate a plurality of first linear predictive filter coefficients (LPC) and a first residual signal. The apparatus also includes means for calculating frequency response of the plurality of the first LPC to generate a first magnitude spectrum and a first phase spectrum. The apparatus further includes means for converting the first residual signal into frequency-domain signal to generate a second magnitude spectrum and a second phase spectrum. The second magnitude spectrum corresponds to magnitude component of the first residual signal in frequency domain and the second phase spectrum corresponds to phase component of the first residual signal in frequency domain. The apparatus also includes means for estimating a third magnitude spectrum based on the first magnitude spectrum and means for estimating a fourth magnitude spectrum based on the second magnitude spectrum. The third magnitude spectrum may correspond to the speech signal component, and the fourth magnitude spectrum may also correspond to the speech signal component. The apparatus also includes means for synthesizing output signals based on the third magnitude spectrum and the fourth magnitude spectrum.

IV. BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure.

Figure 9:
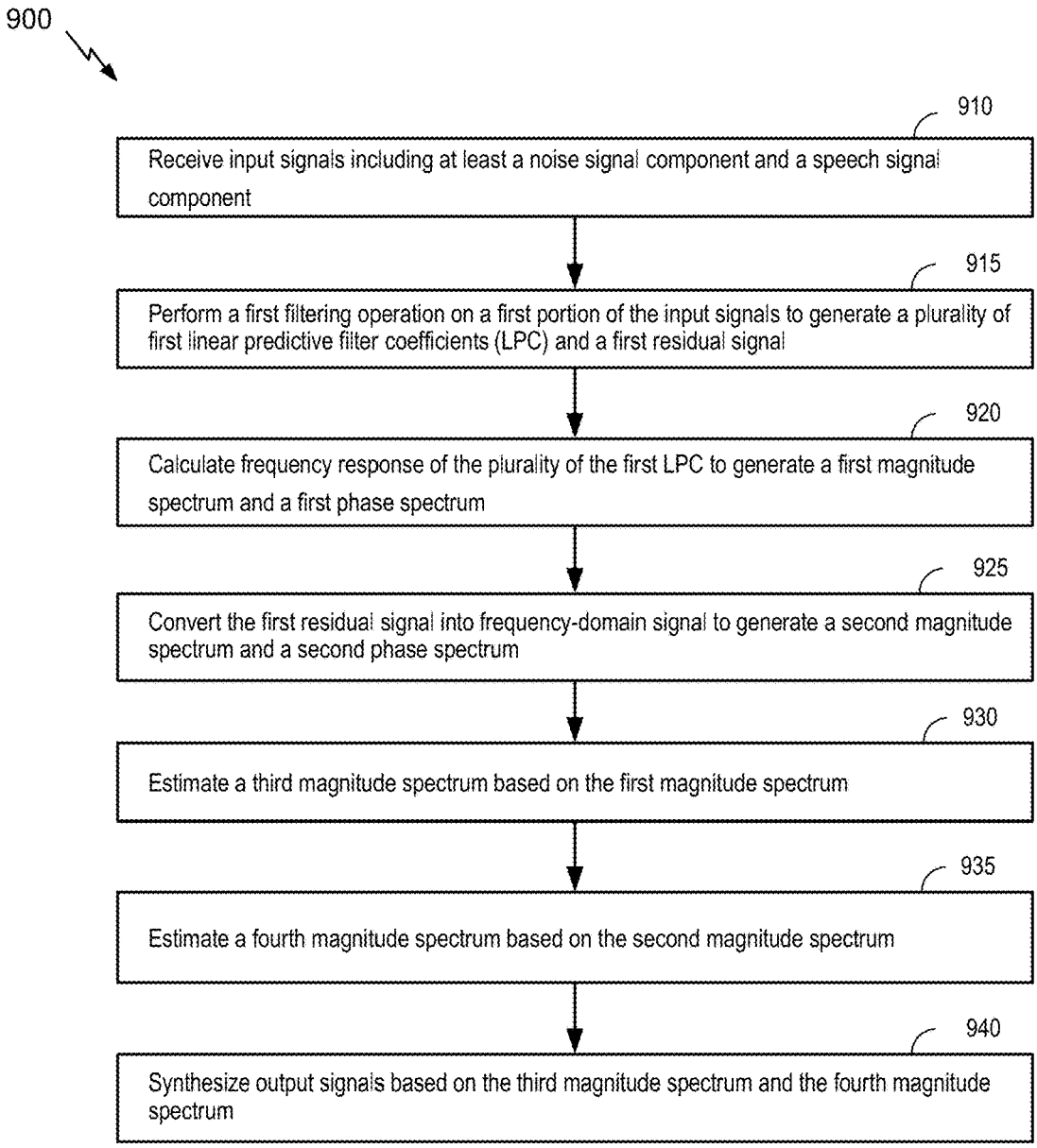
Figure 10:
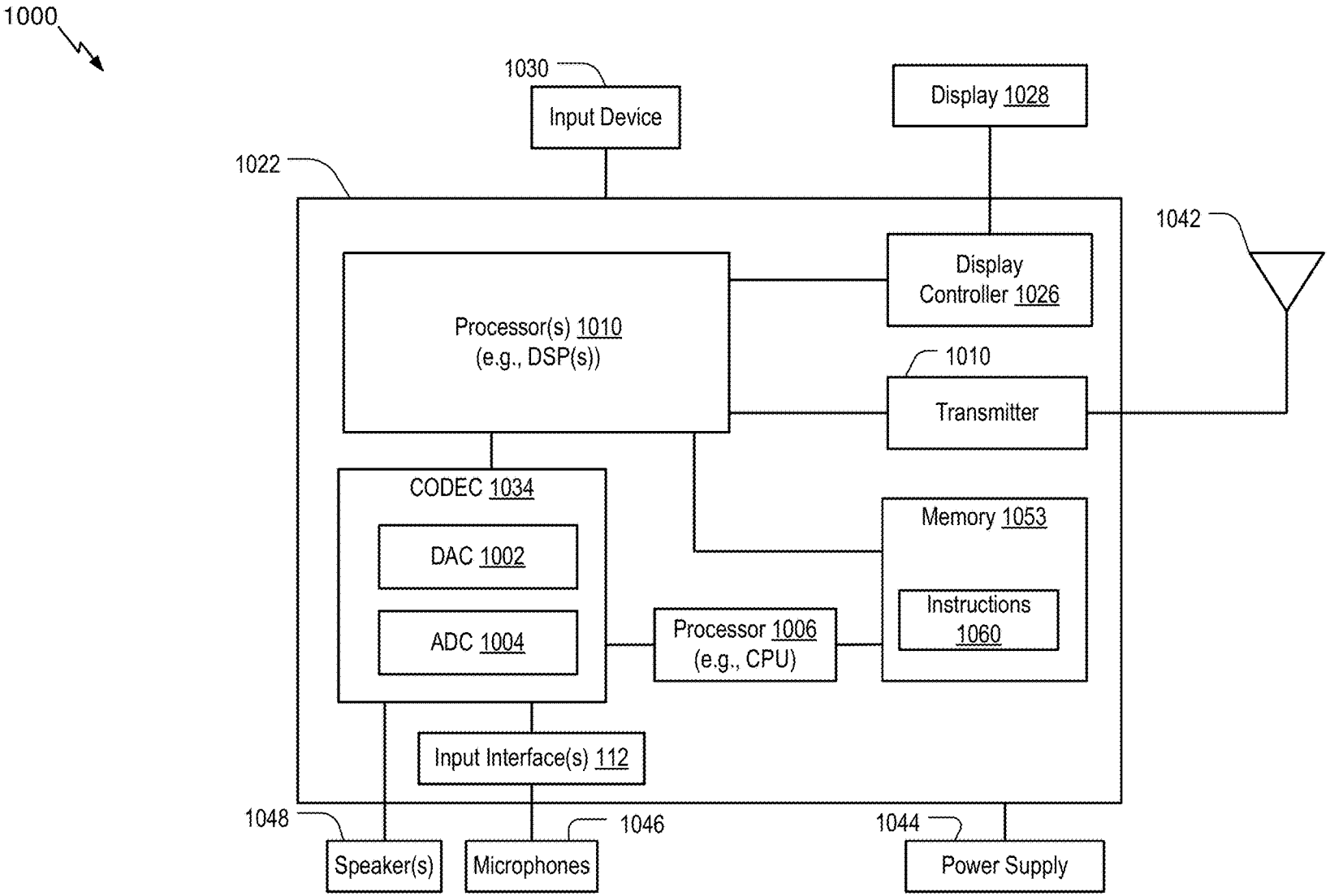

FIG. 9 a flow chart illustrating a particular method of speech signal enhancement in split-signal domain; and FIG. 10 is a block diagram of a particular illustrative example of a device that is operable to enhance speech signal in split-signal domain.

V. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "detecting", "estimating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "estimating", "using", "selecting", "accessing", and "determining" may be used interchangeably. For example, "generating", "calculating", "estimating", or "determining" a parameter (or a signal) may refer to actively generating, estimating, calculating, or determining the parameter (or the signal) or may refer to using, selecting, or accessing the parameter (or signal) that is already generated, such as by another component or device.

Figure 1:
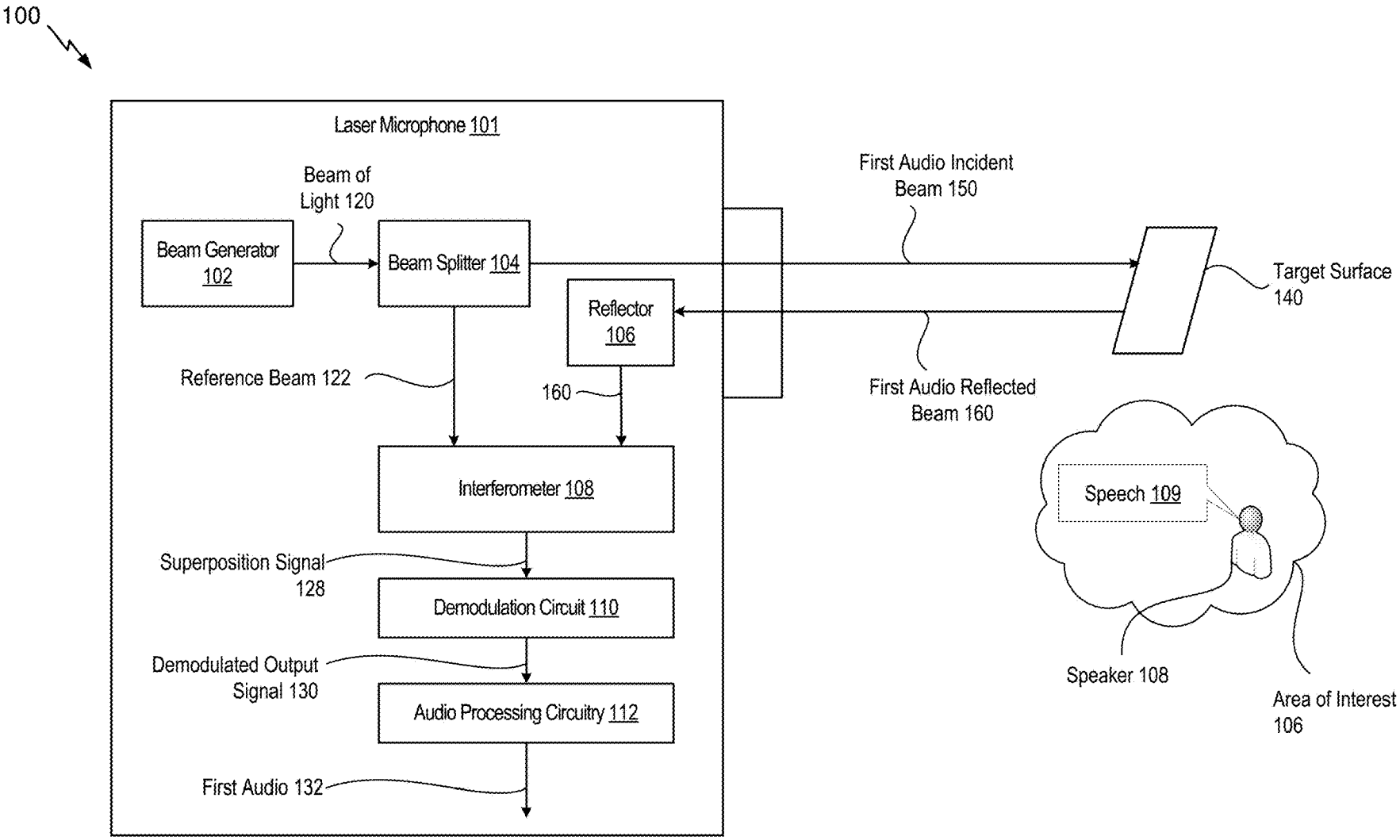
FIG. 1 is a diagram of a laser microphone capturing first audio based on vibrations of a first target surface.

FIG. 1 illustrates a block diagram of a system 100 including a laser microphone 101 capturing the first audio using the target surface 140. A speaker 108 is located in an area of interest 106. As non-limiting examples, the area of interest 106 may be a room, a corner of a room, a particular area outside, etc. In the implementation of FIG. 1, a target surface 140 is proximate to the area of interest 106 and the speaker 108 generates speech 109 (e.g., talks). The laser microphone 101 is configured to capture the speech 109 based on vibrations of surfaces proximate to (or within) the area of interest 106. Sound waves associated with the speech 109 collide with (e.g., reflect from) the target surface 140 and cause the target surface 140 to vibrate. As described in greater detail below, the laser microphone 101 directs incident light beams at the target surface 140 to determine the effects that the vibrations of the target surface 140 have on properties of the incident light beams. The effects that the vibrations have on the incident light beams are represented in reflected light beams from the target surface 140. Because the vibrations of the target surface 140 are based on the sound waves associated with the speech 109, as described below, the speech 109 may be captured by performing a superposition operation on the reflected light beams and light beams having properties similar to the incident light beams (e.g., reference light beams). It should be noted that the techniques described herein may be used to capture any sound and are not limited to speech. Additionally, in other implementations, the target surface 140 correlates to different portions of the same surface. As a non-limiting example, the target surface 110 can correspond to a first portion of a wall that is relatively far from the speaker 108, a second portion of the wall that is closer in proximity to the speaker 108, or a third portion of the wall that is closest in proximity to the speaker 108.

According to one implementation, the laser microphone 101 is a vibrometer. As a non-limiting example, the laser microphone 101 may be a Laser Doppler Vibrometer. The laser microphone 101 includes a beam generator 102, a beam splitter 104, a reflector 106, an interferometer 108, a demodulation circuit 110, and audio processing circuitry 112.

The beam generator 102 is configured to generate a beam of light 120. The beam of light 120 has a particular frequency and a particular phase. The beam generator 102 directs the beam of light 120 towards the beam splitter 104. The beam splitter 104 is configured to split the beam of light 120 into a reference beam 122 and into a first audio incident beam 150. The reference beam 122 and the first audio incident beam 150 have similar properties. For example, the reference beam 122 and the first audio incident beam 150 have similar frequencies and phases. According to one implementation, the particular frequency of the beam of light 120 is similar to the frequencies of the beams 122 150, and the particular phase of the beam of light 120 is similar to the phases of the beams 122 150. The beam splitter 104 splits the beam of light 120 such that the reference beam 122 is provided to the interferometer 108 and the first audio incident beam 150 is directed towards the target surface 140.

The first audio incident beam 150 is reflected from the target surface 140 as a first audio reflected beam 160. The first audio reflected beam 160 may have different properties (e.g., a different frequency, a different phase, or both) than the first audio incident beam 150 based on the vibrations of the target surface 140. For example, the frequency of the first audio reflected beam 160 and the phase of the first audio reflected beam 160 are based on the velocity and the displacement (e.g., the vibrations) of the target surface 140. The vibrations of the target surface 140 are based on sound waves of the speech 109 colliding with the target surface 140. Thus, the frequency of the first audio reflected beam 160 and the phase of the first audio reflected beam 160 is representative, at least in part, of the speech 109.

The first audio reflected beam 160 is directed at the reflector 106, and the reflector 106 redirects the first audio reflected beam 160 to the interferometer 108. According to one implementation, the first audio reflected beam 160 is directed to the interferometer 108 without use of the reflector 106. The interferometer 108 is configured to perform a superposition operation on the first audio reflected beam 160 and the reference beam 122 to generate a superposition signal 128. The superposition signal 128 is provided to the demodulation circuit 110. The demodulation circuit 110 is configured to generate a demodulated output signal 130 based on the superposition signal 128. The demodulated output signal 130 indicates the shift (e.g., the "Doppler" shift) in frequency between the reference beam 122 and the first audio reflected beam 160. As described above, the shift in frequency is based on the sound waves of the speech colliding with the target surface 140. The demodulated output signal 130 is provided to the audio processing circuitry 112. The audio processing circuitry 112 is configured to perform audio processing operations to generate first audio 132 that is reflective of the speech 109.

The quality of the demodulated output signal 130 or the first audio 132 is generally quite poor (e.g., low signal to noise ratio) due to various noise types including background noise, or any other noise introduced due to a location of the target surface 140, a material of the target surface 140, or the vibration of the target surface 140. As non-limiting examples, these noise types may include impulsive noise generally caused by sudden movements of any object (e.g., vehicle, airplane, or structural movements due to wind) proximate to the area of interest 106. The material of the target surface 140 has quite significant impact on the quality of the demodulated output signal 130 or the first audio 132 as well. For example, frequent formant distortions may occur depending on a certain surface property (e.g., wood) of the target surface 140. The use or non-use of retroreflective tape material on the target surface 140 may cause irregular scattering of beams resulting in weaker signal level, or the loss of harmonics or phase information in high frequency range of the first audio reflected beam 160.

Figure 2:
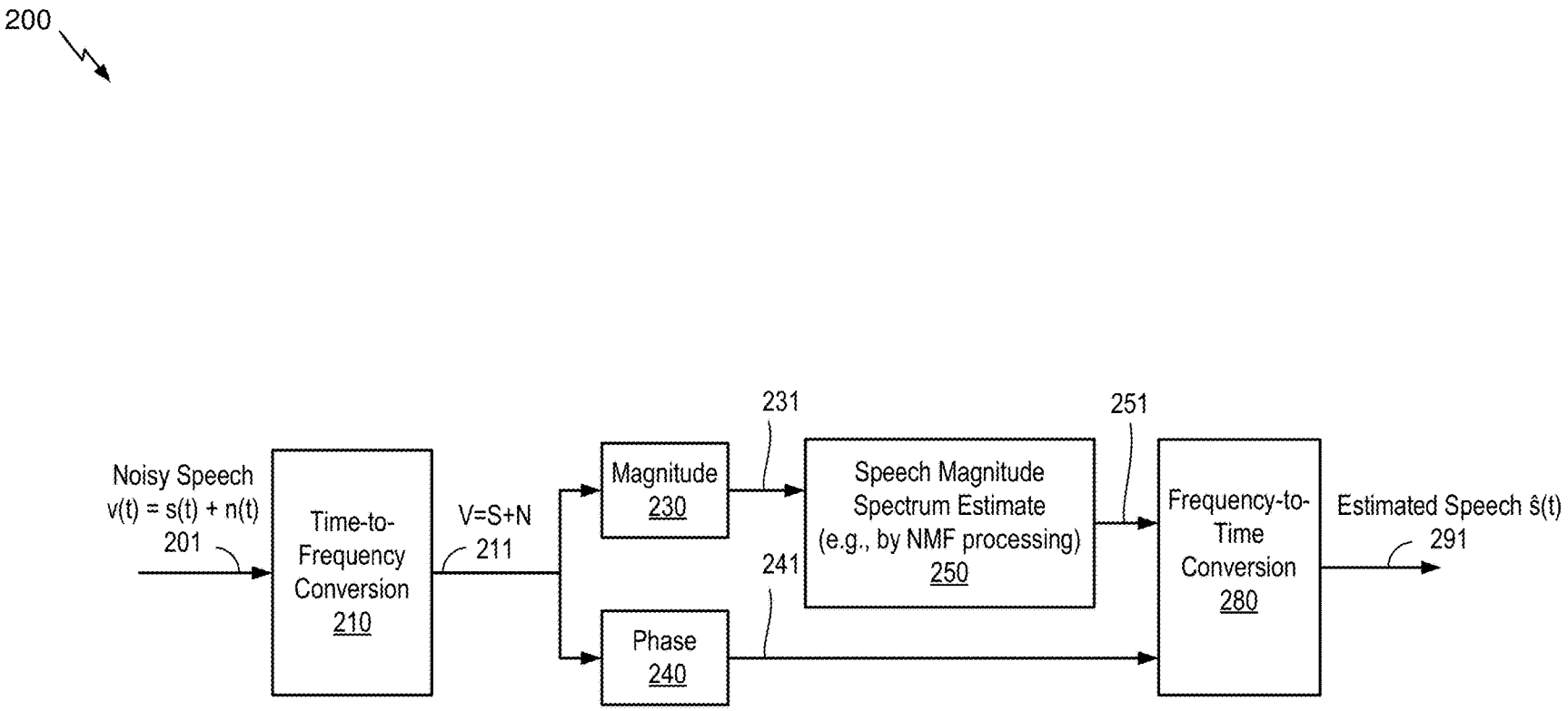
FIG. 2 is a diagram of an illustrative system that is operable to enhance speech signal in frequency domain.

Referring to FIG. 2, a diagram of an illustrative a system 200 operable to enhance speech signal in frequency domain is disclosed. The system 200 includes time-to-frequency conversion block 210, frequency-to-time conversion block 280, and speech magnitude spectrum estimate block 250. The time-to-frequency conversion block 210 receives input signal or, interchangeably, noisy speech signal v(t) 201 which includes a speech signal s(t) and noise n(t). The speech signal s(t) may be the speech 109 and the noise n(t) may be the various noise types explained in preceding paragraphs. The time-to-frequency conversion block 210 transforms the time-domain noisy speech signal 201 into frequency-domain noisy speech signal 211. In some implementations, the time-to-frequency conversion block 210 may be implemented by Fast Fourier Transform (FFT), Discrete Fourier Transform (DFT), Discrete Cosine Transform (DCT), Modified DCT (MDCT), Karhunen-Loève Trasnform (KLT), or any other known time to frequency conversion techniques. The frequency-domain noisy speech signal 211 is generally complex number. The magnitude and the phase spectrum of the complex value of the frequency-domain noisy speech signal 211 may be calculated by magnitude block 230 and phase block 240, respectively.

The speech magnitude spectrum estimate block 250 receives the magnitude spectrum 231 of the frequency-domain noisy speech signal 211 and estimates magnitude spectrum corresponding to speech signal s(t) (e.g., the speech 109). The speech magnitude spectrum estimate block 250 improves the quality and/or intelligibility of the input signal corrupted by noises. To illustrate, the speech magnitude spectrum estimate block 250 may be implemented based on Wiener filtering, MMSE estimator, signal enhancement algorithms based on machine learning technologies (e.g., DNN, RNN, or CNN), or any other denoising methods.

In some implementations, the speech magnitude spectrum estimate block 250 may be implemented based on noise reduction algorithm using non-negative matrix factorization (NMF). An NMF-based denoising or signal enhancement is generally known to be quite effective to remove both stationary and non-stationary noise including impulsive noise. An NMF is a linear basis decomposition technique, with additional constraint on non-negative input, output, basis, and/or weights vectors. The objective of an NMF is to find a set of basis vectors $W=[w_1\ w_2\ \ldots\ w_r]$ to represent an observation vector v as a linear combination of the basis vectors. In other words, given a set of n m-dimensional observations $V=[v_1\ v_2\ \ldots\ v_n]\in\mathbb{R}^{m\times n}$, the objective of an NMF is to find a set of r m-dimensional basis vectors $W=[w_1\ w_2\ \ldots\ w_r]\in\mathbb{R}^{m\times r}$ and respective coefficients or weights $H=[h_1\ h_2\ \ldots\ h_n]\in\mathbb{R}^{r\times n}$ to reconstruct the observations V as linear combinations of basis vectors: $\hat{V}=WH$ such that the reconstruction of V by $\hat{V}$ by has minimal error as measured by some cost function $D(V\|\hat{V})$: $W, H=\text{argmin}_{W,H} D(V\|WH)$.

The matrix of basis vectors W is often called "the dictionary," the matrix of reconstruction coefficients or weights H is called "the activation matrix," and the matrix containing the observation vectors V is called "the observation matrix." The NMF imposes the constraint that the elements of the basis vectors W and the coefficients of reconstruction coefficients or weights H be non-negative (i.e., all elements of the matrices W and H must be non-negative). This constraint also implies that the observation matrix V must also contain only non-negative elements.

In case the size r equals to either n or m, then an NMF becomes trivial representing perfect reconstruction. For instance, if the size r equals to n, then W=V and $H=I_{n\times n}$. Likewise, if the size r equals to m, then $W=I_{m\times m}$ and H=V. Selecting r<n and m, however, enforces an NMF to uncover latent structure in data or the observation matrix, generating smaller W and H such that they represent a compressed representation (or sparse representation) of V. The smaller the size of r is, the more sparsity or compression can be achieved.

To illustrate, examples of the cost function D may be based on Frobenius norm (e.g., $D(V\|WH)=\|V-WH\|_F$), which leads to Minimum Mean Squrared Error (MMSE) reconstruction, generalized Kullback-Leibler (KL) divergence (e.g., $D(V\|WH)=d_{KL}(V\|WH)$), Itakura-Saito (IS) or Euclidean distance. In some embodiment, separate cost function may be used for different types of signal characteristics. As a non-limiting example, KL cost function may be used for signals corresponding to speech signals and IS cost function may be used for signals corresponding to music or any other tonal signals.

According to one embodiment, the speech magnitude spectrum estimate block 250 may be implemented based on noise reduction or speech signal enhancement algorithms using NMF techniques as described in preceding paragraphs. To illustrate, the speech dictionary $W_S$ and the noise dictionary $W_N$ are trained first based on known speech and noise signals. In practice, the speech signal used for training of the speech dictionary $W_S$ may be a clean speech signal and, likewise, the noise signal used for training of the noise dictionary $W_N$ may be extracted from inactive (e.g., silence) portion of the speech signal, or pre-recorded noise signal captured from noise only environment. Second, once the speech dictionary $W_S$ and the noise dictionary $W_N$ are known from the training stage, the next step is to identify both the activation matrix for speech $H_S$ and the activation matrix for noise $H_N$ such that they satisfy the following $V=W_S H_S+W_N H_N$ subject to cost function, wherein V is the magnitude spectrum 231 of the frequency-domain noisy speech signal 211. In one implementation, the speech magnitude spectrum estimate block 250 may estimate speech magnitude spectrum $\hat{V}$ 251, for example, by $\hat{V}\cong W_S H_S$.

The frequency-to-time conversion block 280 converts the estimated speech magnitude spectrum 251 into time-domain estimated speech signal 291 by performing reverse conversion operations corresponding to a particular time-to-frequency conversion method used in the time-to-frequency conversion block 210. To illustrate, the frequency-to-time conversion block 280 may be implemented by conversion operations such as Inverse FFT, Inverse DFT, Inverse DCT, Inverse MDCT, Inverse KLT, or any other known frequency-to-time conversion techniques. It is well known that human ears are generally less sensitive to phase change or distortions introduced during denoising or signal enhancement process. In some implementation, the frequency-to-time conversion block 280 may use the original phase spectrum 241 of the original frequency-domain noisy speech signal, or alternatively the phase spectrum 241 may be processed (not shown in the FIG. 2) further prior to being fed into the frequency-to-time conversion block 280.

Figure 3:
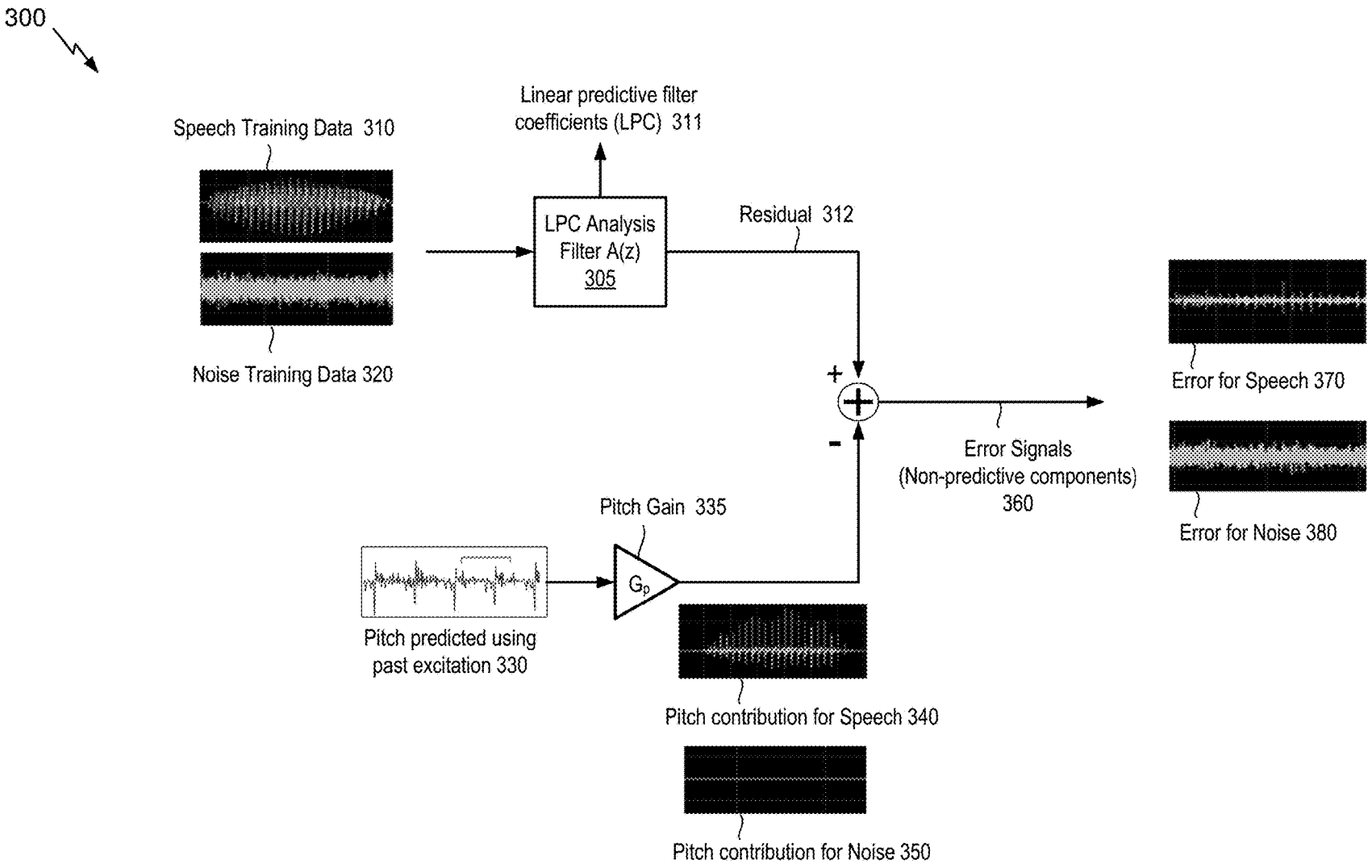
FIG. 3 is a diagram illustrating a particular example of linear-predictive speech signal processing.

FIG. 3 shows a diagram illustrating a particular example of linear-predictive speech signal processing. The novel techniques in the present specification is disclosed with respect to a code excited linear prediction (CELP)-type coding system for the purpose of presenting a non-limitative illustration. However, ordinary skilled in the art should appreciate that the novel techniques may be applicable to different LP-based coding systems in a similar manner described herein. According to a widely accepted speech signal processing model (e.g., source-filtering model), speech signal is produced by convolution of an excitation source component (e.g., "excitation signal," or interchangeably "residual signal") and a time-varying vocal tract component. The LP-based speech coding is a technique well known to those of ordinary skill in the art. The LP-based speech coding comprises LP analysis, LP synthesis, and many other signal processing operations between the LP analysis and the LP synthesis. For example, those processing operations may include quantization and interpolation. Quantization and interpolation of the LP filter coefficients is believed to be otherwise well known to those of ordinary skill in the art and, accordingly, will not be further described in the present disclosure. An LP analysis is the deconvolution process to separate the excitation source and vocal tract components from the input speech signal. Likewise, an LP synthesis is the convolution process to generate synthesized speech signal based on an estimated excitation source component and an estimated vocal tract component.

LP analysis models the current sample of input signal as a linear combination of past p input samples as follows: $\hat{v}(t)=-\Sigma_{k=1}^{p} a_k v(t-k)$, where p is the order of prediction filter (e.g., linear-predictive filter order). The parameters $a_k$ are the coefficients of the transfer function of an LP filter given by the following relation $A(z)=1+\Sigma_{k=1}^{p} a_k z^{-k}$. The primary objective of LP analysis is to compute linear predictive filter coefficients (LPC) or LP coefficients such that the prediction error $e(t)=v(t)-\hat{v}(t)$ is minimized. The popular method to compute or estimate LP coefficients is by autocorrelation or autocovariance approaches based on Levinson-Durbin recursion. The LP coefficients may be transformed into another equivalent domain known to be more suitable for quantization and interpolation purposes. In one embodiment, the line spectral pair (LSP) and immittance spectral pair (ISP) domains are two popular domains in which quantization and interpolation can be efficiently performed. For instance, the $16^{th}$ order LPC may be quantized in the order of 30 to 50 bits using split or multi-stage quantization, or a combination thereof in either LSP or ISP domains. The LP coefficients or their corresponding LSP or ISP domain coefficients may be interpolated to improve processing performance.

The LPC analysis filter block 305 receives input signal and performs an LP analysis to generate residual signal 312 and LPC 311. The input signal may be clean speech signal (e.g., speech training data 310), clean noise signal (e.g., noise training data 320), or alternatively noisy speech signal that includes both speech signal component and noise signal component. The residual signal 312 corresponds to an excitation source component and the LPC 311 corresponds to a vocal tract component, which is frequently referred to as "formant" or "formant structure."

The residual signal, or excitation, signal 312 excites human speech production system and thereby generates glottal wave. The residual signal 312 may be divided further into predictive component and non-predictive component. The predictive component is often termed as "pitch" and may be estimated as a combination of past excitation signals 330 called as "adaptive codebook (ACB)" in a typical CELP-type coding system. The non-predictive component is often termed as "innovation" and may be estimated by combination of series of unitary pulses 370 called as "fixed codebook (FCB)."

During the production of voiced speech, the speech signal waveform for voiced speech 310 is quite periodic in nature because the air exhaling out of lungs is interrupted periodically by vibrating vocal folds. Therefore, during voiced speech period, the estimate of pitch contribution 340 becomes more significant than the estimate of non-predictive component 360 in the residual signal 312. The estimate of pitch contribution 340, which is often called as ACB contribution, may be represented as a scaled (e.g., by a pitch gain 335) version of past excitation signal 330 (e.g., ACB codebook). During the production of unvoiced speech, however, the speech signal waveform for unvoiced speech 310 is non-periodic in nature because the air exhaling out of lungs is not interrupted by the vibration of the vocal folds. Therefore, during unvoiced speech period, the estimate of non-predictive component (e.g., FCB contribution) 370 becomes more significant than the estimate of pitch contribution 340 in the residual signal 312.

It is observed that clean noise only data may be deconvoluted into multiple domain signal in a similar manner as clean speech only data. In one implementation, the noise training data 320 may be deconvoluted by the LPC analysis filter block 305 into LPC 311 and residual signal 312. Likewise, the residual signal 312 for noise training data 320 may be divided further into predictive component (e.g., pitch contribution for noise 350) and non-predictive component 380.

Figure 4:
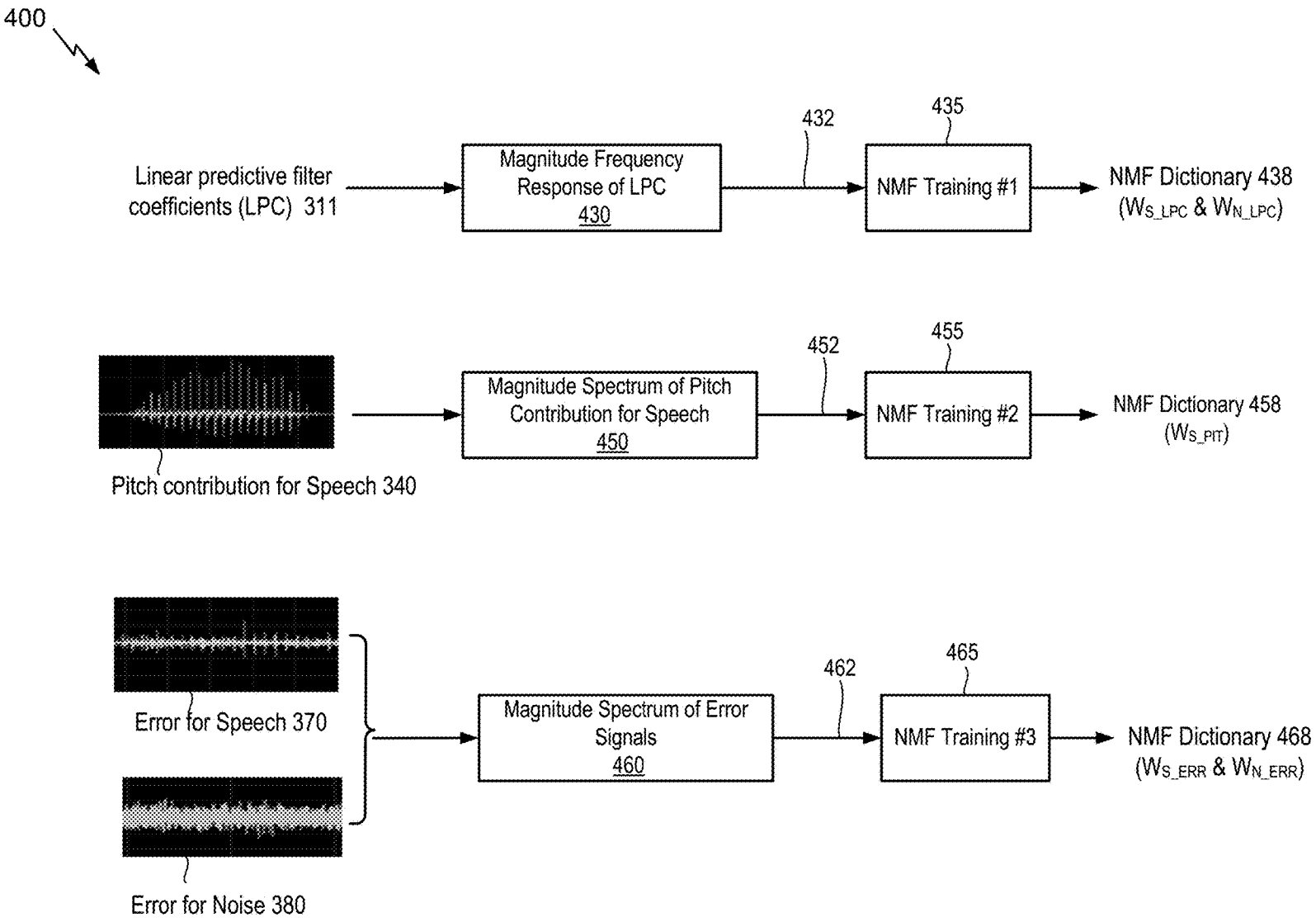
FIG. 4 is a diagram illustrating a particular NMF training example.

FIG. 4 shows a diagram illustrating a particular NMF training. An NMF-based denoising technique is based on constrained model and thus it requires training of data. In an NMF literature, training is the process of iteratively identifying a dictionary W and an activation H until it converges to a local minimum of a cost function D(V||WH). To illustrate, the exemplary training procedure for the Frobenius norm cost function (MMSE) is as follows. First, it requires selecting the desired dictionary size r, given observation matrix V. Second, it randomly initializes both W and H. Then, the training iteratively updates both H and W until maximum number of iteration has not been satisfied, nor have H and W converged:

$$\text{Update } H{:}H \leftarrow H \odot \frac{W^T V}{W^T W H} \text{ and Update } W{:}W \leftarrow W \odot \frac{V H^T}{W H H^T},$$

wherein $\odot$ is the Hadamard (elementwise) product and divisional operations of matrices are done elementwise. Skilled person in the art would appreciate this particular training procedure is only for illustration purpose and any other similar training procedures may be used without loss of generality for various cost functions.

As a non-limiting example, FIG. 4 shows NMF training for a plurality of signals in split domain. Split-domain processing in the present application refers to processing (e.g., signal enhancement, NMF training, or NMF de-noising) on the outputs of LP analysis. The outputs of LP analysis may be LPC and residual signal. For example, an NMF training 435 may be performed for the LPC 311 to generate a first trained dictionary 438. It may be desirable to perform NMF training on a signal derived from the LPC 311. For example, the frequency response of the LPC 311 may be obtained, and the magnitude spectrum 432 and/or phase spectrum of the frequency response of the LPC may be obtained prior to the first NMF training 435. Then, as shown in FIG. 4, the first NMF training 435 may be performed on the magnitude spectrum 432 of the frequency response of the LPC to generate a first trained dictionary $W_{LPC}$ 438. Alternatively, a plurality of dictionaries may be trained by the first NMF training 435. For example, speech LPC dictionary $W_{S_LPC}$ 438 and noise LPC dictionary $W_{N_LPC}$ 438 may be trained separately based on separate speech and noise inputs. In practice, the speech signal used for training of the speech LPC dictionary $W_{S_LPC}$ 438 may be a clean speech signal (e.g., speech training data 310) and the noise signal used for training of the noise LPC dictionary $W_{N_LPC}$ 438 may be noise only signal (e.g., noise training data 320).

Another NMF training may be performed for the residual signal 312 to generate a second trained dictionary 458 468. Alternatively, as shown in FIG. 4, separate NMF trainings may be performed for both a predictive component and a non-predictive component of the residual signal 312. A second NMF training 455 may be performed for pitch contribution speech (ACB contribution or predictive component) 340 to generate a second trained dictionary, and a third NMF training 465 may be performed for error signals (non-predictive component) 360 370 380 to generate a third trained dictionary.

It may be desirable to perform NMF training on a signal derived from the residual signal 312. In one implementation, magnitude spectrum 452 of pitch contribution for speech 340 (e.g., magnitude spectrum 452 of the predictive component of the residual signal 312) may be obtained prior to the second NMF training 455. Then, the second NMF training 455 may be performed on the magnitude spectrum 452 of pitch contribution for speech 340 to generate a second trained dictionary $W_{S_PIT}$ 458. In another implementation, magnitude spectrum 462 of non-predictive component 370 380 (e.g., magnitude spectrums 462 of the error signal for speech 370 and the error signal for noise 380) may be obtained, prior to the third NMF training 465. Then, the third NMF training 465 may be performed on the magnitude spectrum 462 of non-predictive component 370 380 to generate a trained dictionary $W_{ERR}$ 468. Alternatively, a plurality of dictionaries may be trained by the third NMF training 465 as shown in FIG. 4. For example, speech error dictionary WS ERR 468 and noise error dictionary $W_{N_ERR}$ 468 may be trained separately based on separate speech and noise inputs. In practice, the speech signal used for training of the speech error dictionary $W_{S_ERR}$ 468 may be a clean speech signal (e.g., speech training data 310) and the noise signal used for training of the noise error dictionary $W_{N_ERR}$ 468 may be noise only signal (e.g., noise training data 320).

Figure 5:
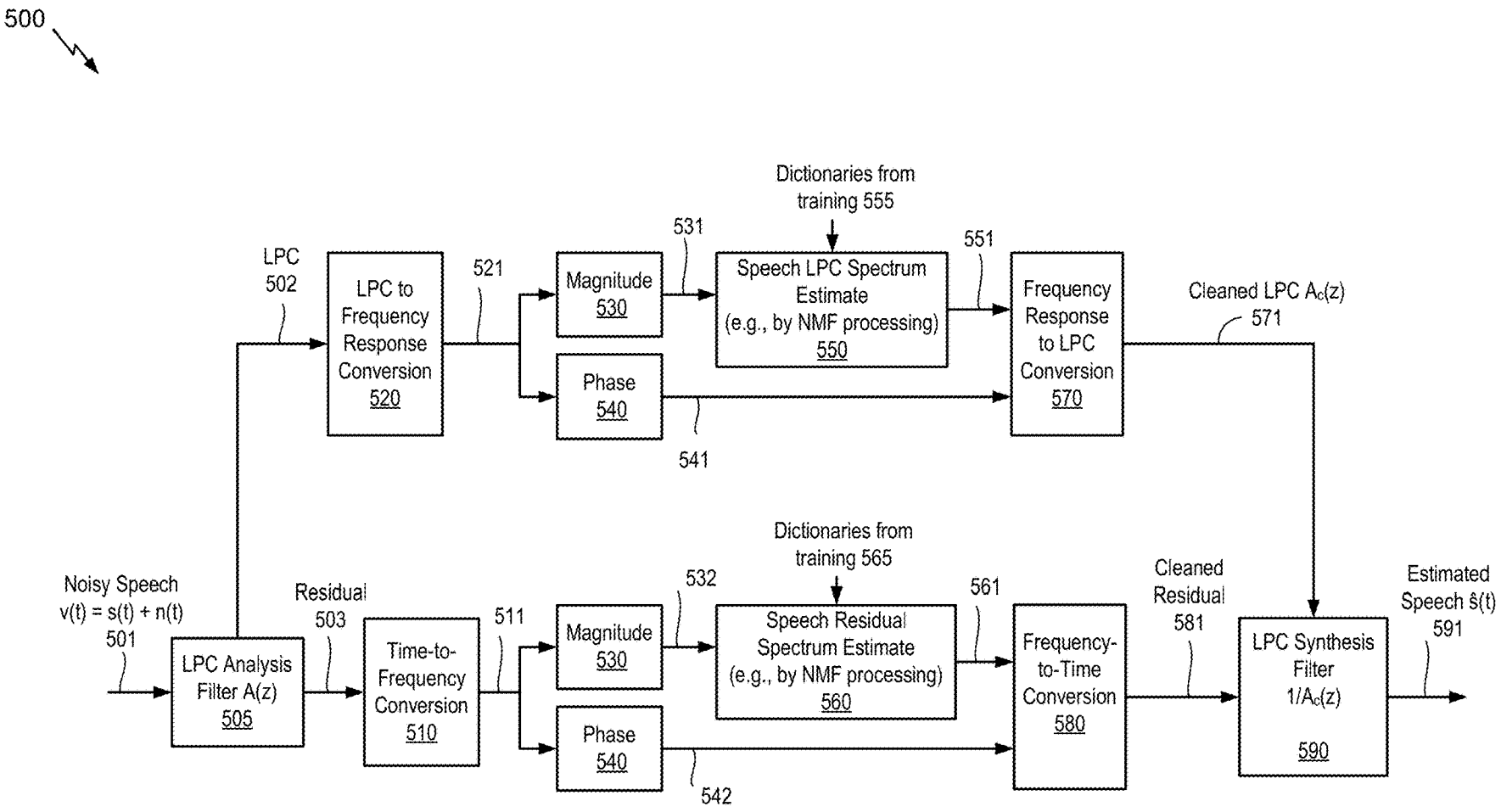
FIG. 5 is a diagram of an illustrative system that is operable to enhance speech signal in a split domain.

Referring to FIG. 5, a diagram of an illustrative system 500 operable to enhance speech signal in a split domain is disclosed. The system 500 may include a number of blocks that may operate substantially in a similar or same manner as the blocks already included in the system 200. For example, these blocks may include time-to-frequency conversion block 510, frequency-to-time conversion block 580, magnitude block 530, and phase block 540. The system 500 may include additional blocks that were not included in the system 200, such as linear predictive filter coefficients (LPC) analysis filter block 505, LPC synthesis filter block 590, LPC to frequency response conversion block 520, frequency response to LPC conversion block 570, speech LPC spectrum estimate block 550, and speech residual spectrum estimate block 560.

The LPC analysis filter block 505 receives the noisy speech signal 501 and performs linear prediction (LP) analysis to generate residual signal 503 and linear predictive filter coefficients (LPC) 502 or, interchangeably, LP coefficients. The noisy speech signal v(t) 501 may correspond to an input signal and may include speech signal s(t) and additional noise signal n(t). According to a widely accepted speech signal processing model (e.g., source-filtering model), speech signal is produced by the convolution of an excitation source component (e.g., "excitation signal" or "residual signal") and a time-varying vocal tract component. An LP analysis is a technique well known to those of ordinary skill in the art as one of deconvolution processes to separate the excitation source and vocal tract components from the input speech signal. The residual signal 503 may correspond to the excitation source component and the LPC 502 may correspond to the time-varying vocal tract component.

In a preferred embodiment, LP analysis models the current sample of input signal as a linear combination of past p input samples as follows: $\hat{v}(t)=-\Sigma_{k=1}^{p}a_k v(t-k)$, where p is the order of prediction filter (e.g., LPC filter order). The parameters $a_k$ are the coefficients of the transfer function of an LP filter given by the following relation $A(z)=1+\Sigma_{k=1}^{p}a_k z^{-k}$. The primary objective of LP analysis is to compute the LP coefficients (LPC) such that the prediction error $e(t)=v(t)-\hat{v}(t)$ is minimized. The popular method to compute or estimate LP coefficients is by autocorrelation or autocovariance approaches based on Levinson-Durbin recursion.

The LP coefficients may be transformed into another equivalent domain known to be more suitable for quantization and interpolation purposes. In one embodiment, the line spectral pair (LSP) and immittance spectral pair (ISP) domains are two popular domains in which quantization and interpolation can be efficiently performed. For instance, the $16^{th}$ order LPC may be quantized in the order of 30 to 50 bits using split or multi-stage quantization, or a combination thereof in either LSP or ISP domains. The LP coefficients or their corresponding LSP or ISP domain coefficients may be interpolated to improve processing performance. Quantization and interpolation of the LP filter coefficients is believed to be otherwise well known to those of ordinary skill in the art and, accordingly, will not be further described in the present disclosure.

The LPC analysis filter block 505 may perform down-sampling operation on the input signal. For example, the noisy speech signal 501 may be down-sampled from 32 kHz down to 12.8 kHz to reduce the computational complexity of algorithm and to improve the coding efficiency. The LPC analysis filter block 505 may perform pre-processing blocks such as high-pass filtering to remove unwanted sound components below a certain cut-off frequency, or pre-emphasis filtering to enhance the high frequency contents of the noisy speech signal 501 or to achieve enhanced perceptual weighting of the quantization error based on a pre-emphasis factor whose typical value is in the range between 0 and 1. The LPC analysis filter block 505 may perform windowing operation on input signal prior to LP analysis. The window function used in the window operation may be a Hamming or any similar type of any window.

Additionally, or alternatively, the system 500 may determine whether to apply LP analysis depending on some factors. For example, if the system 500 may decide not to apply LP analysis, then the system 500 may be reduced to be substantially similar to the system 200 because the upper processing path (e.g., processing path for LPC signals 502) and LPC synthesis filter block 590 may not be required in that case. For illustrative purpose, the system 200 may be referred to as "PCM-domain" processing because the signal enhancement by speech magnitude spectrum estimate block 250 is performed on the frequency domain spectrum 231 of PCM-domain input samples. In contrast, the system 500 may be referred to as "split-domain" processing because overall signal enhancement on the output signal may be achieved by contribution from both LPC-domain processing and residual-domain processing. FIG. 4. shows upper path of signal enhancement ("LPC-domain processing") in which cleaned LPC 571 is estimated by the speech LPC spectrum estimate block 550 based on NMF dictionaries 555. FIG. 4. shows lower path of signal enhancement ("residual-domain processing") in which cleaned residual 581 is estimated by the speech residual spectrum estimate block 560 based on NMF dictionaries 565. The overall enhancement on the estimated speech signal 591 is achieved by the LPC synthesis filter block 590 based on the cleaned LPC 571 and the cleaned residual 581.

In one embodiment, one of the factors to consider in determining whether to apply LP analysis or not may be signal characteristic of input signal. For example, signal picked up by a laser microphone tends to show high-pass tilted noise (e.g., noise estimate such as laser speckle noise whose spectrum is tilted to higher frequency range) when there is no retroreflective tape or paint applied to the target surface. Experiment results show separation of noise signal and speech signal in split-domain is easier than the separation in PCM domain (e.g., the system 200). In this case, the system 500 may decide to perform LP analysis on the noisy speech signal 501 based on a characteristic of noise estimate of the noisy speech signal 501. In another example, it is observed that the laser microphone signal reflected from poor surface material (e.g., wood or any material causing irregular scattering of laser light) tends to show more severe formant distortions than the signal reflected from good surface material (e.g., reflective tape or any material causing regular scattering of laser light). In this case, the system 500 may decide not to perform LP analysis because separation of noise signal and speech signal is more effective in PCM domain (e.g., the system 200) than in split domain (e.g., the system 500). In another embodiment, another factor to consider in determining whether to apply LP analysis or not may be computation complexity. As a non-limiting example, if a fast processor is used for processing speech signal enhancement (e.g., by NMF training and processing), the system 500 may decide to perform LP analysis because split-domain signal enhancement (e.g., the system 500) tend to produce better performance than PCM domain signal enhancement (e.g., the system 200). In alternative embodiment, whether to apply speech signal enhancement processing in PCM domain or in split domain may be dependent upon an estimated noise type of the noisy speech signal 501.

The time-to-frequency conversion block 510 transforms the residual signal 503 of the noisy speech signal v(t) into frequency-domain residual signal $V_{RES}$ 511. In some implementations, the time-to-frequency conversion block 510 may be implemented by Fast Fourier Transform (FFT), Discrete Fourier Transform (DFT), Discrete Cosine Transform (DCT), Modified DCT (MDCT), Karhunen-Loève Trasnform (KLT), or any other known time to frequency conversion techniques. The frequency-domain residual signal $V_{RES}$ 511 is generally complex number. The magnitude block 530 generates magnitude spectrum $|V_{RES}|$ 532 based on the complex value of the frequency-domain residual signal $V_{RES}$ 511, and the phase block 540 generates phase spectrum 542 based on the complex value of the frequency-domain residual signal $V_{RES}$ 511.

The speech residual spectrum estimate block 560 receives the magnitude spectrum $|V_{RES}|$ 532 of the frequency-domain residual signal $V_{RES}$ 511 and estimates magnitude residual spectrum $|\hat{S}_{RES}|$ 1561 corresponding to speech signal s(t) (e.g., the speech 109). In other words, the speech residual spectrum estimate block 560 improves the quality and/or intelligibility of the input signal corrupted by noises. To illustrate, the speech residual spectrum estimate block 560 may be implemented based on Wiener filtering, MMSE estimator, signal enhancement algorithms based on machine learning technologies (e.g., DNN, RNN, or CNN), or any other denoising methods.

In some implementations, the speech residual spectrum estimate block 560 may be implemented based on noise reduction (de-noising) algorithms using NMF techniques. At this stage, it is assumed that at least one dictionary 565 is known from NMF training stage. In one implementation, the at least one dictionary 565 from training may include (A) the pitch contribution dictionary WS PIT 458 trained based on the pitch contribution (predictive component) for speech 340; (B) the speech error dictionary $W_{S_ERR}$ 468 trained based on the error signal (non-predictive component) for speech 370; and (C) the noise error dictionary $W_{N_ERR}$ 468 trained based on the error signal (non-predictive component) for noise 380. When these dictionaries are known, the magnitude spectrum $|\hat{V}_{RES}|$ 532 of the residual 503 of the noisy speech signal 501 may be estimated as follows: $|\hat{V}_{RES}| \cong (W_{S_PIT} H_{S_PIT} + W_{S_ERR} H_{S_ERR}) + W_{N_ERR} H_{N_ERR}$, where $H_{S_PIT}$ is an activation matrix for the pitch contribution (predictive component) of the noisy speech signal 501, $H_{S_ERR}$ is an activation matrix for the error signal (non-predictive component) corresponding to the speech s(t) in the noisy speech signal 501, and $H_{N_ERR}$ is an activation matrix for the error signal (non-predictive component) corresponding to the noise n(t) in the noisy speech signal 501.

The primary goal of the speech residual spectrum estimate block 560 is to identify activation matrices $H_{S_PIT}$, $H_{S_ERR}$, and $H_{N_ERR}$ such that the cost function $D(|V_{RES}| \| |\hat{V}_{RES}|)$ may be minimized. Once these activation matrices have been identified, then the speech residual spectrum estimate block 560 may estimate magnitude residual spectrum $|\hat{S}_{RES}|$ 561 corresponding to speech signal s(t) as follows by discarding $H_{N_ERR}$ or resetting $H_{N_ERR}=0$: $|\hat{S}_{RES}| = (W_{S_PIT} H_{S_PIT} + W_{S_ERR} H_{S_ERR})$.

In some implementations, the at least one dictionary 565 from NMF training stage may be further processed prior to be used for NMF de-noising by the speech residual spectrum estimate block 560. As a non-limiting example, the noise error dictionary $W_{N_ERR}$ 468 may be filtered by periodicity enhancement filter to improve the periodicity of harmonic signals, or by perceptual weighting filter to shape quantization error such that they are less noticeable to human ears.

The frequency-to-time conversion block 580 converts the estimated speech residual magnitude spectrum $|\hat{S}_{RES}|$ 561 into time-domain estimated speech residual signal 581 by performing reverse conversion operations corresponding to a particular time-to-frequency conversion method used in the time-to-frequency conversion block 510. In an ideal situation, the estimated speech residual signal 581 may only include residual signal corresponding to speech signal component ("cleaned residual") without including residual signal corresponding to noise signal component. To illustrate, the frequency-to-time conversion block 580 may be implemented by conversion operations such as Inverse FFT, Inverse DFT, Inverse DCT, Inverse MDCT, Inverse KLT, or any other known frequency-to-time conversion techniques. In some implementation, the frequency-to-time conversion block 580 may use the phase spectrum 542 of the original frequency-domain residual signal, or alternatively the phase spectrum 542 may be processed (not shown in the FIG. 5) further prior to being fed into the frequency-to-time conversion block 580.

Figure 6:
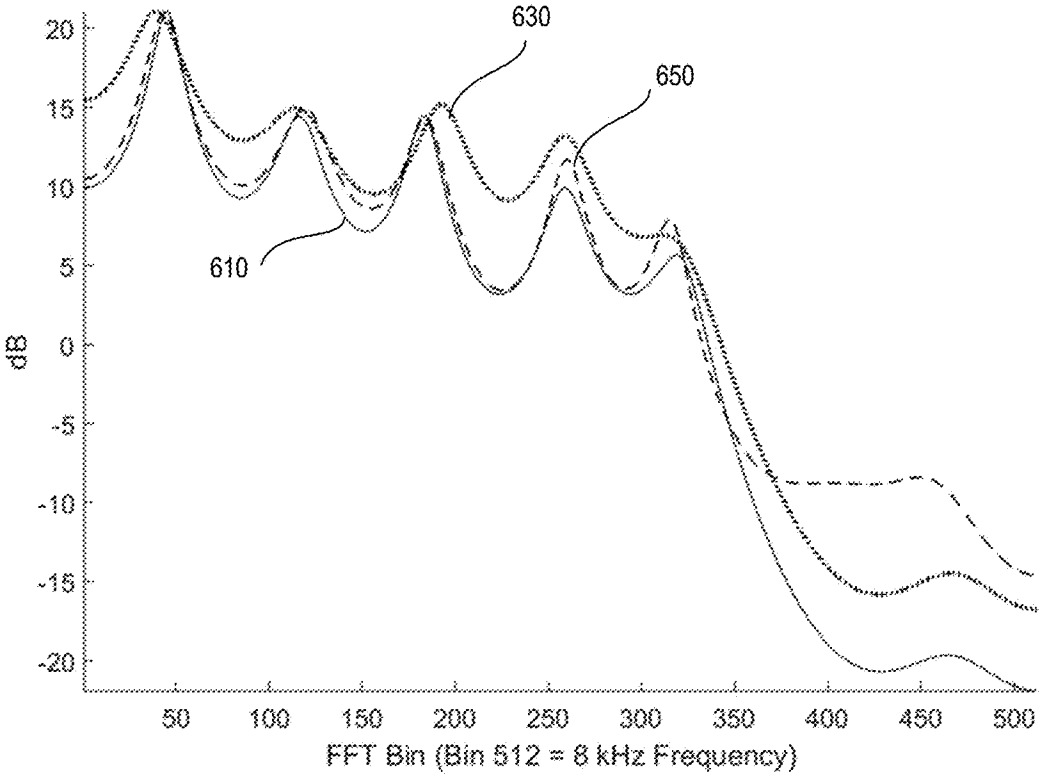
FIG. 6 is a graph illustrating magnitude frequency responses of a particular example of linear-predictive filter coefficients (LPC)

The LPC to frequency response conversion block 520 calculates frequency response 521 of an LPC filter based on a linear prediction filter coefficients (LPC) 502 received from the LPC analysis filter block 505. The frequency response 512 of an LPC filter may be complex number, and it may be further processed by magnitude block 530 (or phase block 540) to generate magnitude spectrum 531 (or phase spectrum 541) of the frequency response 521 of an LPC filter. For example, the exemplary magnitude spectrum 531 of the frequency response of an LPC filter is shown in FIG. 6. The solid line 610 in FIG. 6 represents magnitude spectrum of the frequency response of an LPC filter. The x-axis of the FIG. 6 may be an index referring to a particular frequency bin (e.g., FFT bin in this example) and the y-axis is dB scale magnitude of the frequency response of an LPC filter.

Returning back to FIG. 5, the speech LPC spectrum estimate block 550 receives the magnitude spectrum $|V_{LPC}|$ 531 of the frequency response 521 of the LPC 502 and estimates magnitude LPC spectrum $|\hat{S}_{LPC}\sim$ 551 corresponding to speech signal component s(t) (e.g., the speech 109). In other words, the speech LPC spectrum estimate block 550 improves the quality and/or intelligibility of the input signal corrupted by noises. To illustrate, the speech LPC spectrum estimate block 550 may be implemented based on Wiener filtering, MMSE estimator, signal enhancement algorithms based on machine learning technologies (e.g., DNN, RNN, or CNN), or any other denoising methods.

In some implementations, the speech LPC spectrum estimate block 550 may be implemented based on noise reduction (de-noising) algorithms using NMF techniques. At this stage, it is assumed that at least one dictionary 555 is known from NMF training stage. In one implementation, the at least one dictionary 555 from training may include (A) the speech LPC dictionary $W_{S_LPC}$ 438 trained based on the LPC 311 derived from speech training data 310; and (B) the noise LPC dictionary $W_{N_LPC}$ 438 trained based on the LPC 311 derived from noise training data 320. When these dictionaries are known, the magnitude spectrum $|V_{LPC}|$ 531 of the LPC 502 of the noisy speech signal 501 may be estimated as follows: $|V_{LPC}| \cong W_{S_LPC} H_{S_LPC} + W_{N_LPC} H_{N_LPC}$ where $H_{S_LPC}$ is an activation matrix for the LPC 502 corresponding to signal s(t) of the noisy speech signal 501, and $H_{N_LPC}$ is an activation matrix for the LPC 502 corresponding to noise n(t) of the noisy speech signal 501.

The primary goal of the speech LPC spectrum estimate block 550 is to identify activation matrices $H_{S_LPC}$, and $H_{N_LPC}$ such that the cost function $D(|V_{LPC}| \| |\hat{V}_{LPC}|)$ may be minimized. Once these activation matrices have been identified, then the speech LPC spectrum estimate block 550 may estimate magnitude LPC spectrum $|\hat{S}_{LPC}|$ 551 corresponding to the speech signal component s(t) (e.g., the speech 109) as follows by discarding $H_{N_LPC}$ or resetting $H_{N_LPC}=0$: $|\hat{S}_{LPC}| \cong W_{S_LPC} H_{S_LPC}$.

The frequency response to LPC conversion block 570 receives an estimated magnitude LPC spectrum $|\hat{S}_{LPC}|$ 551 corresponding to the speech signal component s(t) and calculates LP coefficients ("cleaned LPC") 571 based on the estimated magnitude LPC spectrum $|\hat{S}_{LPC}|$ 551. In some implementation, the frequency response to LPC conversion block 570 may use the phase spectrum 541 of the original frequency response signal 521 of the LPC 502, or alternatively the phase spectrum 541 may be processed (not shown in the FIG. 5) further prior to being fed into the frequency response to LPC conversion block 570.

The LPC synthesis filter block 590 performs LP synthesis to reconstruct synthesized speech signal 591 based on residual signal ("cleaned residual") 581 and LPC ("cleaned LPC") 571. The LP synthesis is well known to those of ordinary skill in the art. The primary purpose of the LP synthesis is to generate synthesized speech signal by modeling human sound production system. In other words, LP synthesis operation corresponds to filtering operation on excitation signal, which models signal generated by vibrations of glottis, with LPC coefficient, which models resonances due to the shape of vocal and nasal tracts.

According to an alternative embodiment, the synthesized speech signal 591 may be reconstructed without having to use the frequency response to LPC conversion block 570. For example, the estimated magnitude LPC spectrum 551 and the phase spectrum 541 of the LPC frequency response may be used to generate a first complex frequency spectrum. In a similar manner, the estimated magnitude residual spectrum 561 and the phase spectrum 542 of the residual signal may be used to generate a second complex frequency spectrum. As a non-limiting example, the synthesized speech signal 591 may be obtained by multiplying the first complex spectrum with the second complex spectrum in the frequency domain, followed by the frequency-to-time conversion block 580.

According to another embodiment, the synthesized speech signal 591 may be reconstructed based on neural network technique. Various types of neural network techniques known to be effective to improve speech signal quality may be used for generating synthesized speech signal 591. A neural network technique may be based on the estimated magnitude LPC spectrum 551, the phase spectrum 541 of the LPC frequency response, the estimated magnitude residual spectrum 561, and the phase spectrum 542 of the residual signal. As a non-limiting example, the neural network technique may include generative deep neural networks. Degenerative deep neural networks may include a plurality of convolutional and/or feedforward network layers. These network layers may comprise large numbers of nodes, each with a set of weights and biases applied to the inputs from previous layers. A non-linear combination of all the inputs to a node may be processed and passed to its output, which then become the inputs to the nodes in the next layer.

In a typical neural network based approach, the weights and biases of the neural network may be adjusted or trained based on a large speech database and additionally based on conditional inputs comprising, for example, a combination of at least one of the magnitude spectrum $|V_{LPC}|$ 531, the estimated magnitude LPC spectrum 551, the magnitude spectrum $|V_{RES}|$ 532, and the estimated magnitude residual spectrum 561, to generate the synthesized speech signal 591. During the training, neural network may generate probability distributions of the speech samples, given the conditional inputs comprising at least one of 531, 551, 532, 561. Upon completion of the initial training phase, the trained generative neural network may be used to generate samples corresponding to the synthesized speech signal 591. Such generative neural network may use its own prior speech samples generated in an autoregressive fashion and additionally the same conditional inputs 531, 551, 532, 561 used during the initial training phase. The goal of a properly trained generative model during the inference stage may be to find the probability distribution having a maximum likelihood, given the test conditionals. This probability distribution may be sampled to generate the synthesized speech signal 591.

Referring to FIG. 6, illustrative magnitude frequency responses 600 of a particular example of LPC are disclosed. The x-axis of the FIG. 6 may be an index referring to a particular frequency bin (e.g., FFT bin in this example) and the y-axis is dB scale magnitude of the frequency response of an LPC filter. The solid line 610 may represent magnitude spectrum of an LPC derived from reference speech signal (e.g., speech training data 310). In this particular example, the solid line 610 shows multiple formant structures (e.g., peaks of the frequency response) at the frequency bins around 55, 110, and 170. In addition, the solid line 610 shows multiple valleys of the frequency response at the frequency bins around 80, 160, and 220. The dotted line 630 may represent magnitude spectrum (or magnitude) of a frequency response of an LPC derived based on the processed output by NMF de-noising in PCM domain (e.g., the system 200). For example, the dotted line 630 may be generated by applying LP analysis filtering on the estimated speech signal 291 in FIG. 2. The dashed line 650 may represent magnitude spectrum (or magnitude) of a frequency response of an LPC derived based on the processed output by NMF de-noising in split domain (e.g., the system 500). For example, the dashed line 650 may be an estimated magnitude LPC spectrum $|\hat{S}_{LPC}|$ 551 corresponding to the speech signal component s(t) (e.g., the speech 109) as described previously with reference to FIG. 5. In this particular example, it is clear that the dashed line 650 (the processed output by NMF de-noising in split domain) shows much better speech signal enhancement performance than the dotted line 630 (the processed output by NMF de-noising in PCM domain). This distinction becomes even more outstanding around the peaks or the valleys. For example, the valleys of the dashed line 650 at the locations of FFT bin around 80 or 220 show much more similarity to the valleys of the solid line 610 than those of the dotted line 630 at the same locations.

Figure 7:
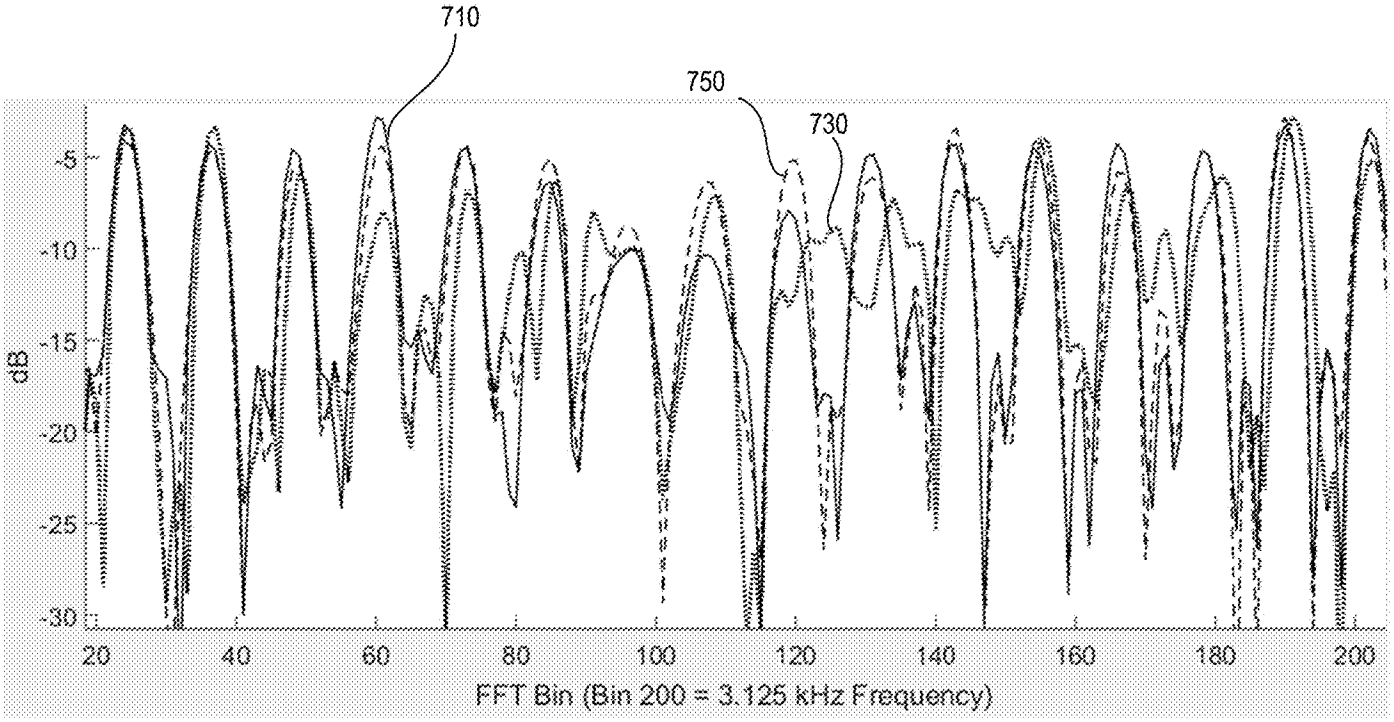
FIG. 7 is a graph illustrating magnitude spectrums of a particular example of residual signal.

Referring to FIG. 7, illustrative magnitude spectrums 700 of a particular example of residual signal are disclosed. The x-axis of the FIG. 6 may be an index referring to a particular frequency bin (e.g., FFT bin in this example) and the y-axis is dB scale magnitude spectrum of residual signal. The solid line 710 may represent magnitude spectrum of a residual signal derived from reference speech signal (e.g., speech training data 310). The dotted line 730 may represent magnitude spectrum residual signal derived based on the processed output by NMF de-noising in PCM domain (e.g., the system 200). For example, the dotted line 730 may be generated by applying LP analysis filtering on the estimated speech signal 291 in FIG. 2. The dashed line 750 may represent magnitude spectrum of residual signal derived based on the processed output by NMF de-noising in split domain (e.g., the system 500). For example, the dashed line 750 may be an estimated magnitude residual spectrum $|\hat{S}_{RES}|$ 561 corresponding to the speech signal component s(t) (e.g., the speech 109) as described previously with reference to FIG. 5. In this particular example, it is clear that the dashed line 750 (the processed output by NMF de-noising in split domain) shows much better speech signal enhancement performance than the dotted line 730 (the processed output by NMF de-noising in PCM domain). This distinction becomes even more outstanding around the peaks leys. For example, the peaks of the dashed line 750 at the locations of FFT bin around 60 or 120 show much more similarity to the peaks of the solid line 710 than those of the dotted line 730 at the same locations.

Figure 8:
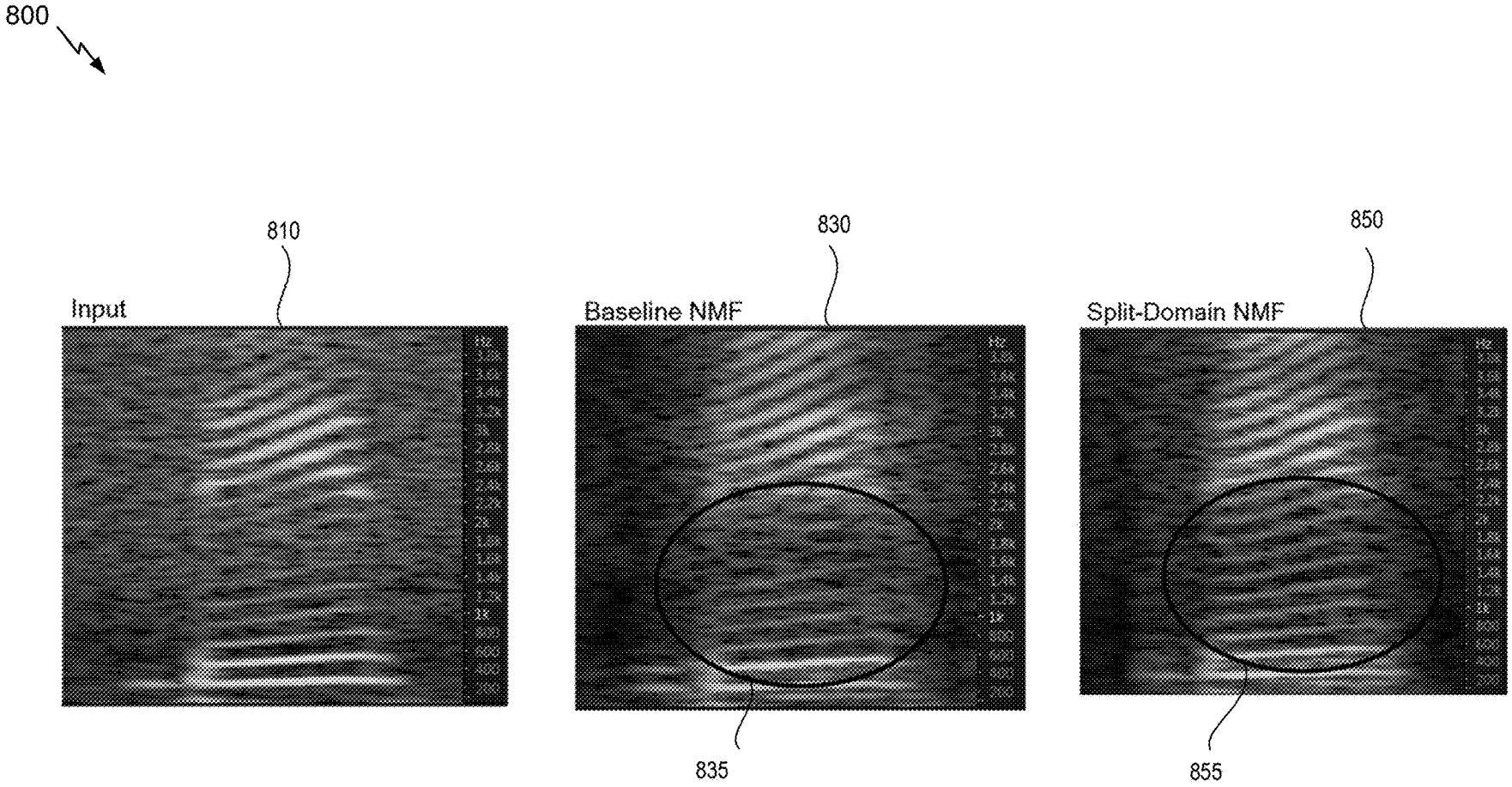
FIG. 8 depicts spectrogram graphs illustrating comparison between input and processed output signals.

Referring to FIG. 8, spectrograms 800 illustrating comparison between input and processed output signals are disclosed. The first spectrogram 810 may be the spectrogram of the noisy speech signal 201 501. The second spectrogram 830 may be the spectrogram of the processed output (the estimated speech signal 291) by NMF de-noising in PCM domain (e.g., the system 200). The third spectrogram 850 may be the spectrogram of the processed output (the estimated speech signal 591) by NMF de-noising in split domain (e.g., the system 500). In this particular example, the circular area 855 of the third spectrogram 850, the output of the NMF de-noising in split domain, clearly shows much more improved harmonic characteristic than other circular area 835 of the second spectrogram 830, the output of the NMF de-noising in PCM domain.

Referring to FIG. 9, a method 900 of enhancing speech signal in split-signal domain is disclosed. The method 900 includes receiving input signals, at 910. The input signals may include at least a noise signal component and a speech signal component. For example, the input signals may be the noisy speech signal v(t) 501.

The method 900 includes performing a first filtering operation on a first portion of the input signals to generate a plurality of first linear predictive filter coefficients (LPC) and a first residual signal, at 915. The first filtering operation may be an LP analysis filtering operation that generates LPC and residual signal. For example, the first filtering operation may be performed by the LPC analysis filter block 505, and its output may correspond to the LPC 502 and the residual 503. In some implementation the LPC 502 may be transformed into another equivalent domain known to be more suitable for quantization and interpolation purposes such as LSP or ISP domains for further downstream processing in accordance with algorithms described herein.

The method 900 includes calculating frequency response of the plurality of the first LPC to generate a first magnitude spectrum and a first phase spectrum, at 920. For example, the LPC to frequency response conversion block 520 may calculate frequency response 521 of an LPC filter based on the LPC 502, and the magnitude block 530 and the phase block 540 may generate a first magnitude spectrum 531 and a first phase spectrum 541, respectively, based on the frequency response 521.

The method 900 includes converting the first residual signal into frequency-domain signal to generate a second magnitude spectrum and a second phase spectrum, at 925. For example, the time-to-frequency conversion block 510 may convert the residual signal 503 of the noisy speech signal v(t) into the frequency-domain residual signal $V_{RES}$ 511. In some implementations, converting the first residual signal into frequency-domain residual signal may be implemented by FFT, DFT, DCT, MDCT, KLT, or any other known time to frequency conversion techniques. The frequency-domain residual signal $V_{RES}$ 511 is generally complex number. In some implementation, the magnitude block 530 may generate a second magnitude spectrum (e.g., $|V_{RES}|$ 532) and the phase block 540 may generate a second phase spectrum 542 based on the complex value of the frequency-domain residual signal $V_{RES}$ 511.

The method 900 includes estimating a third magnitude spectrum based on the first magnitude spectrum, at 930. For example, the method 930 may be performed by the speech LPC spectrum estimate block 550. The speech LPC spectrum estimate block 550 may estimate magnitude LPC spectrum $|\hat{S}_{LPC}|$ 551 corresponding to speech signal component s(t) based on the magnitude spectrum $|V_{LPC}|$ 531. In some implementations, the speech LPC spectrum estimate block 550 may the estimate magnitude LPC spectrum $|\hat{S}_{LPC}|$ 551 corresponding to speech signal component s(t) based on NMF-based de-noising algorithms. For example, the speech LPC spectrum estimate block 550 may use (A) the speech LPC dictionary $W_{S_LPC}$ 438 and (B) the noise LPC dictionary $W_{N_LPC}$ 438. When these dictionaries are available from NMF training stage, the speech LPC spectrum estimate block 550 may identify activation matrices $H_{S_LPC}$, and $H_{N_LPC}$ such that the cost function $D(|V_{LPC}|||\hat{V}_{LPC}|)$ may be minimized, where $|\hat{V}_{LPC}| \cong W_{S_LPC}\ H_{S_LPC} + W_{N_LPC}\ H_{N_LPC}$. Once these activation matrices have been identified, then the speech LPC spectrum estimate block 550 may estimate magnitude LPC spectrum $|\hat{S}_{LPC}|$ 551 corresponding to the speech signal component s(t) by discarding $H_{N_LPC}$ contribution as follows: $|\hat{S}_{LPC}| \cong W_{S_LPC}\ H_{S_LPC}$.

The method 900 includes estimating a fourth magnitude spectrum based on the second magnitude spectrum, at 935. For example, the method 935 may be performed by the speech residual spectrum estimate block 560. The speech residual spectrum estimate block 560 may estimate magnitude residual spectrum $|\hat{S}_{RES}|$ 561 corresponding to speech signal s(t) based on the magnitude spectrum $|V_{RES}|$ 532. In some implementations, the speech residual spectrum estimate block 560 may estimate the magnitude residual spectrum $|\hat{S}_{RES}|$ 561 corresponding to speech signal component s(t) based on NMF-based de-noising algorithms. For example, the speech residual spectrum estimate block 560 may use (A) the pitch contribution dictionary $W_{S_PIT}$ 458, (B) the speech error dictionary $W_{S_ERR}$ 468, and (C) the noise error dictionary $W_{N_ERR}$ 468. When these dictionaries are available from NMF training stage, the speech residual spectrum estimate block 560 may identify activation matrices $H_{S_PIT}$, $H_{S_ERR}$, and $H_{N_ERR}$ such that the cost function $D(|V_{RES}|||\hat{V}_{RES}|)$ may be minimized, where $|\hat{V}_{RES}| \cong (W_{S_PIT}\ H_{S_PIT} + W_{S_ERR}\ H_{S_ERR})\ W_{N_ERR}\ H_{N_ERR}$. Once these activation matrices have been identified, then the speech residual spectrum estimate block 560 may estimate magnitude residual spectrum $|\hat{S}_{RES}|$ 561 corresponding to speech signal s(t) as follows by discarding $H_{N_ERR}$ contribution as follows: $|\hat{S}_{RES}| = (W_{S_PIT}\ H_{S_PIT} + W_{S_ERR}\ H_{S_ERR})$.

The method 900 includes synthesizing output signals based on the third magnitude spectrum and the fourth magnitude spectrum, at 940. For example, the method 940 may be performed by a combination of at least one of the frequency response to LPC conversion block 570, the frequency-to-time conversion block 580, and the LPC synthesis filter block 590. Synthesizing the output signals may be based on a neural network technique as illustrated with reference to FIG. 5. In one implementation, the neural network may include generative deep neural networks.

According to another embodiment, the method 940 may further include calculating a plurality of second linear predictive filter coefficients (LPC) based on the third magnitude spectrum. The frequency response to LPC conversion block 570 may calculate LP coefficients ("cleaned LPC") 571 based on the estimated magnitude LPC spectrum $|\hat{S}_{LPC}|$ 551. In some implementation, the frequency response to LPC conversion block 570 may use the phase spectrum 541 of the original frequency response signal 521, or alternatively the phase spectrum 541 may be processed further prior to being fed into the frequency response to LPC conversion block 570.

Additionally, the method 940 may further include converting the fourth magnitude spectrum into time-domain signal to generate a second residual signal. The frequency-to-time conversion block 580 may convert the estimated speech residual magnitude spectrum $|\hat{S}_{RES}|$ 561 into the time-domain estimated speech residual signal 581 by performing reverse conversion operations corresponding to a particular time-to-frequency conversion method used, at 925. In an ideal situation, the estimated speech residual signal 581 may only include residual signal corresponding to speech signal component ("cleaned residual"). In some implementation, the frequency-to-time conversion block 580 may use the phase spectrum 542 of the original frequency-domain residual signal, or alternatively the phase spectrum 542 may be processed further prior to being fed into the frequency-to-time conversion block 580.

Additionally, the method 940 may further include performing a second filtering operation based on the plurality of the second LPC and the second residual signal to generate output signals. The second filtering operation may be an LP synthesis filtering operation that generates synthesized speech signal based on LPC and residual signal. For example, the LPC synthesis filter block 590 may perform the second filtering operation based on both residual signal ("cleaned residual") 581 and LPC ("cleaned LPC") 571 and may generate output signals corresponding to the synthesized speech signal 591.

Referring to FIG. 10, a block diagram of an illustrative example of a device that is operable to enhance speech signal in split-signal domain is disclosed and generally designated 1000. In various embodiments, the device 1000 may have fewer or more components than illustrated in FIG. 10. In an illustrative embodiment, the device 1000 may perform one or more operations described with reference to systems and methods of FIGS. 1-9.

In a particular embodiment, the device 1000 includes a processor 1006 (e.g., a central processing unit (CPU)). The device 1000 may include one or more additional processors 1010 (e.g., one or more digital signal processors (DSPs)). The device 1000 may include the transmitter 1010 coupled to an antenna 1042. The device 1000 may include a display 1028 coupled to a display controller 1026. The device 1000 may include a memory 1053 and a CODEC 1034. One or more speakers 1048 may be coupled to the CODEC 1034. One or more microphones 1046 may be coupled, via an input interface(s) 112, to the CODEC 1034. In a particular implementation, the microphones 1046 may include a laser microphone 101 of FIG. 1, The CODEC 1034 may include a digital-to-analog converter (DAC) 1002 and an analog-to-digital converter (ADC) 1004. In a particular implementation, the input interfaces(s) 112 may perform one or more operations described with reference to FIGS. 1-9.

The memory 1053 may include instructions 1060 executable by the processor 1006, the processors 1010, the CODEC 1034, another processing unit of the device 1000, or a combination thereof, to perform one or more operations described with reference to FIGS. 1-9. One or more components of the device 1000 may be implemented via dedicated hardware (e.g., circuitry), by a processor executing instructions to perform one or more tasks, or a combination thereof. As an example, the memory 1053 or one or more components of the processor 1006, the processors 1010, and/or the CODEC 1034 may be a memory device, such as a random access memory (RAM), magneto-resistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 1060) that, when executed by a computer (e.g., a processor in the CODEC 1034, the processor 1006, and/or the processors 1010), may cause the computer to perform one or more operations described with reference to FIGS. 1-9. As an example, the memory 1053 or the one or more components of the processor 1006, the processors 1010, and/or the CODEC 1034 may be a non-transitory computer-readable medium that includes instructions (e.g., the instructions 1060) that, when executed by a computer (e.g., a processor in the CODEC 1034, the processor 1006, and/or the processors 1010), cause the computer to perform one or more operations described with reference to FIGS. 1-9.

In a particular embodiment, the device 1000 may be included in a system-in-package or system-on-chip device (e.g., a mobile station modem (MSM)) 1022. In a particular embodiment, the processor 1006, the processors 1010, the display controller 1026, the memory 1053, the CODEC 1034, and the transmitter 1010 are included in a system-in-package or the system-on-chip device 1022. In a particular embodiment, an input device 1030, such as a touchscreen and/or keypad, and a power supply 1044 are coupled to the system-on-chip device 1022. Moreover, in a particular embodiment, as illustrated in FIG. 10, the display 1028, the input device 1030, the speakers 1048, the microphones 1046, the antenna 1042, and the power supply 1044 are external to the system-on-chip device 1022. However, each of the display 1028, the input device 1030, the speakers 1048, the microphones 1046, the antenna 1042, and the power supply 1044 can be coupled to a component of the system-on-chip device 1022, such as an interface or a controller.

In a particular implementation, one or more components of the systems described herein and the device 1000 may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems described herein and the device 1000 are described as being performed by certain components or modules. This division of components and modules is for illustration only. In an alternate implementation, a function performed by a particular component or module may be divided amongst multiple components or modules. Moreover, in an alternate implementation, two or more components or modules of the systems described herein may be integrated into a single component or module. Each component or module illustrated in systems described herein may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for receiving input signals. For example, the means for receiving the input signals may include the microphones 1046 of FIG. 1. The apparatus may also include means for performing a first filtering operation and means for performing a second filtering operation. For example, the means for performing the first filtering operation and the means for performing the second filtering operation may include a processor in the CODEC 1034, the processor 1006, and/or the processors 1010.

The apparatus may also include means for converting a time-domain signal to a frequency domain signal and means for converting a frequency-domain signal to a time-domain signal. For example, the means for converting the time-domain signal to the frequency domain signal and the means for converting the frequency-domain signal to the time-domain signal may include a processor in the CODEC 1034, the processor 1006, and/or the processors 1010. The apparatus may also include means for calculating a frequency response to generate magnitude and phase spectrums. For example, the means for calculating the frequency response to generate the magnitude and phase spectrums may include a processor in the CODEC 1034, the processor 1006, and/or the processors 1010.

The apparatus may also include means for estimating a magnitude spectrum based on another magnitude spectrum. For example, the means for estimating the magnitude spectrum based on another magnitude spectrum may include a processor in the CODEC 1034, the processor 1006, and/or the processors 1010. The apparatus may also include means for calculating a plurality of a linear predictive filter coefficients (LPC) based on a magnitude spectrum. For example, the means for calculating the plurality of a linear predictive filter coefficients (LPC) based on the magnitude spectrum may include a processor in the CODEC 1034, the processor 1006, and/or the processors 1010.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random-access memory (RAM), magneto-resistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method for estimating speech signal at an electronic device, the method comprising:

receiving, at a microphone, input signals, wherein the input signals include at least a noise signal component and a speech signal component;

determining, by the electronic device, whether to perform a first filtering operation based on a characteristic of the input signals;

performing, by the electronic device, the first filtering operation on a first portion of the input signals to generate a plurality of first linear predictive filter coefficients (LPC) and a first residual signal;

calculating, by the electronic device, frequency response of the plurality of the first LPC to generate a first magnitude spectrum and a first phase spectrum, wherein the first magnitude spectrum corresponds to magnitude component of the frequency response and the first phase spectrum corresponds to phase component of the frequency response;

converting, by the electronic device, the first residual signal into frequency-domain signal to generate a second magnitude spectrum and a second phase spectrum, wherein the second magnitude spectrum corresponds to magnitude component of the first residual signal in frequency domain and the second phase spectrum corresponds to phase component of the first residual signal in frequency domain;

estimating, by the electronic device, a third magnitude spectrum based on the first magnitude spectrum, wherein the third magnitude spectrum corresponds to the speech signal component;

estimating, by the electronic device, a fourth magnitude spectrum based on the second magnitude spectrum, wherein the fourth magnitude spectrum corresponds to the speech signal component; and synthesizing output signals, by the electronic device, based on the third magnitude spectrum and the fourth magnitude spectrum.

2. The method of claim 1, wherein synthesizing the output signals comprises:

calculating, by the electronic device, a plurality of second linear predictive filter coefficients (LPC) based on the third magnitude spectrum;

and performing, by the electronic device, a second filtering operation based at least in part on the plurality of the second LPC to generate the output signals.

3. The method of claim 2, wherein synthesizing the output signals comprises converting, by the electronic device, the fourth magnitude spectrum into time-domain signal to generate a second residual signal, wherein the second filtering operation to generate the output signals is based on the second residual signal.

4. The method of claim 1, wherein estimating the third magnitude spectrum is based on one among a non-negative matrix factorization technique and a neural network based technique.

5. The method of claim 1, wherein estimating the fourth magnitude spectrum is based on one among a non-negative matrix factorization technique and a neural network based technique.

6. The method of claim 1, wherein estimating the third magnitude spectrum comprises estimating a plurality of weights based at least on one among a speech dictionary and a noise dictionary trained in linear predictive filter coefficients (LPC) domain.

7. The method of claim 1, wherein estimating the fourth magnitude spectrum comprises estimating a plurality of weights based at least on one among a speech dictionary and a noise dictionary trained in residual signal domain.

8. The method of claim 7, wherein at least one weight of the plurality of weights is perceptually weighted or filtered to enhance periodicity.

9. The method of claim 2, wherein calculating the plurality of the second LPC is further based on the first phase spectrum.

10. The method of claim 3, wherein converting the fourth magnitude spectrum into time-domain signal is further based on the second phase spectrum.

11. The method of claim 2, wherein the first filtering operation corresponds to linear predictive analysis filtering and the second filtering operation corresponds to linear predictive synthesis filtering.

12. The method of claim 6, wherein estimating the third magnitude spectrum comprises:

estimating a first plurality of weight vector based on the speech dictionary; and estimating a second plurality of weight vector based on the noise dictionary, wherein the third magnitude spectrum is based on the first plurality of weight vector.

13. The method of claim 6, wherein estimating the fourth magnitude spectrum comprises:

estimating a third plurality of weight vector based on the speech dictionary; and estimating a fourth plurality of weight vector based on the noise dictionary, wherein the fourth magnitude spectrum is based on the third plurality of weight vector.

14. An apparatus for estimating speech signal, comprising:

a microphone configured to receive input signals, wherein the input signals include at least a noise signal component and a speech signal component;

a memory configured to store the input signals; and a processor coupled to the memory, the processor configured to:

perform a first filtering operation on a first portion of the input signals to generate a plurality of first linear predictive filter coefficients (LPC) and a first residual signal;

calculate frequency response of the plurality of the first LPC to generate a first magnitude spectrum and a first phase spectrum, wherein the first magnitude spectrum corresponds to magnitude component of the frequency response and the first phase spectrum corresponds to phase component of the frequency response;

convert the first residual signal into frequency-domain signal to generate a second magnitude spectrum and a second phase spectrum, wherein the second magnitude spectrum corresponds to magnitude component of the first residual signal in frequency domain and the second phase spectrum corresponds to phase component of the first residual signal in frequency domain;

estimate a third magnitude spectrum based on the first magnitude spectrum, wherein the third magnitude spectrum corresponds to the speech signal component;

estimate a fourth magnitude spectrum based on the second magnitude spectrum, wherein the fourth magnitude spectrum corresponds to the speech signal component;

convert, based on the second phase spectrum, the fourth magnitude spectrum into time-domain signal to generate a second residual signal; and synthesize output signals based on the third magnitude spectrum and the second residual signal.

15. The apparatus of claim 14, wherein the processor is further configured to determine whether to perform the first filtering operation based on a characteristic of the input signals.

16. The apparatus of claim 14, wherein the processor is configured to synthesize the output signals based on a plurality of second linear predictive filter coefficients (LPC) that is based on the third magnitude spectrum.

17. The apparatus of claim 14, wherein the processor is configured to estimate the third magnitude spectrum based on one among a non-negative matrix factorization technique and a neural network based technique.

18. The apparatus of claim 14, wherein the processor is configured to estimate the fourth magnitude spectrum based on one among a non-negative matrix factorization technique and a neural network based technique.

19. The apparatus of claim 14, wherein the processor is further configured to estimate a plurality of weights based at least on one among a speech dictionary and a noise dictionary trained in linear predictive filter coefficients (LPC) domain.

20. The apparatus of claim 14, wherein the processor is further configured to estimate a plurality of weights based at least on one among a speech dictionary and a noise dictionary trained in residual signal domain.

21. The apparatus of claim 19, wherein the processor is further configured to:

estimate a first plurality of weight vector based on the speech dictionary; and estimate a second plurality of weight vector based on the noise dictionary, wherein the third magnitude spectrum is based on the first plurality of weight vector.

22. The apparatus of claim 19, wherein the processor is further configured to:

estimate a third plurality of weight vector based on the speech dictionary; and estimate a fourth plurality of weight vector based on the noise dictionary, wherein the fourth magnitude spectrum is based on the third plurality of weight vector.

23. A non-transitory computer-readable medium comprising instructions that, when executed by a processor, cause the processor to perform operations comprising:

receiving, at a microphone, input signals, wherein the input signals include at least a noise signal component and a speech signal component;

performing a first filtering operation on a first portion of the input signals to generate a plurality of first linear predictive filter coefficients (LPC) and a first residual signal;

calculating frequency response of the plurality of the first LPC to generate a first magnitude spectrum and a first phase spectrum, wherein the first magnitude spectrum corresponds to magnitude component of the frequency response and the first phase spectrum corresponds to phase component of the frequency response;

converting the first residual signal into frequency-domain signal to generate a second magnitude spectrum and a second phase spectrum, wherein the second magnitude spectrum corresponds to magnitude component of the first residual signal in frequency domain and the second phase spectrum corresponds to phase component of the first residual signal in frequency domain;

estimating a third magnitude spectrum based on the first magnitude spectrum, wherein the third magnitude spectrum corresponds to the speech signal component;

calculating a plurality of second linear predictive filter coefficients (LPC) based on the first phase spectrum and the third magnitude spectrum;

estimating a fourth magnitude spectrum based on the second magnitude spectrum, wherein the fourth magnitude spectrum corresponds to the speech signal component; and synthesizing output signals based on the plurality of second LPC and the fourth magnitude spectrum.

24. The non-transitory computer-readable medium of claim 23, wherein synthesizing the output signals comprises:

converting the fourth magnitude spectrum into time-domain signal to generate a second residual signal; and performing a second filtering operation based on the plurality of the second LPC and the second residual signal to generate the output signals.

25. The non-transitory computer-readable medium of claim 23, wherein estimating the third magnitude spectrum is based on one among a non-negative matrix factorization technique and a neural network based technique.

26. The non-transitory computer-readable medium of claim 23, wherein estimating the fourth magnitude spectrum is based on one among a non-negative matrix factorization technique and a neural network based technique.

27. The non-transitory computer-readable medium of claim 23, wherein estimating the third magnitude spectrum comprises:

estimating a first plurality of weight vector based on a speech dictionary; and estimating a second plurality of weight vector based on a noise dictionary, wherein the third magnitude spectrum is based on the first plurality of weight vector, and wherein the speech dictionary and the noise dictionary are trained in linear predictive filter coefficients (LPC) domain.

28. The non-transitory computer-readable medium of claim 23, wherein estimating the fourth magnitude spectrum comprises:

estimating a third plurality of weight vector based on a speech dictionary; and estimating a fourth plurality of weight vector based on a noise dictionary, wherein the fourth magnitude spectrum is based on the third plurality of weight vector, and wherein the speech dictionary and the noise dictionary are trained in residual signal domain.

29. An apparatus for estimating speech signal, comprising:

means for receiving input signals, wherein the input signals include at least a noise signal component and a speech signal component;

means for performing linear predictive analysis filtering on a first portion of the input signals to generate a plurality of first linear predictive filter coefficients (LPC) and a first residual signal;

means for calculating frequency response of the plurality of the first LPC to generate a first magnitude spectrum and a first phase spectrum, wherein the first magnitude spectrum corresponds to magnitude component of the frequency response and the first phase spectrum corresponds to phase component of the frequency response;

means for converting the first residual signal into frequency-domain signal to generate a second magnitude spectrum and a second phase spectrum, wherein the second magnitude spectrum corresponds to magnitude component of the first residual signal in frequency domain and the second phase spectrum corresponds to phase component of the first residual signal in frequency domain;

means for estimating a third magnitude spectrum based on the first magnitude spectrum, wherein the third magnitude spectrum corresponds to the speech signal component;

means for estimating a fourth magnitude spectrum based on the second magnitude spectrum, wherein the fourth magnitude spectrum corresponds to the speech signal component; and means for synthesizing output signals by performing linear predictive synthesis filtering based on the third magnitude spectrum and the fourth magnitude spectrum.

30. The apparatus of claim 29, wherein the means for synthesizing the output signals further comprises:

means for calculating a plurality of second linear predictive filter coefficients (LPC) based on the third magnitude spectrum; and means for converting the fourth magnitude spectrum into time-domain signal to generate a second residual signal; and means for performing the linear predictive synthesis filtering based on the plurality of the second LPC and the second residual signal to generate the output signals.

* * * * *